US010919726B2

(12) United States Patent
Upmeier et al.

(10) Patent No.: US 10,919,726 B2
(45) Date of Patent: Feb. 16, 2021

(54) WIRELINE SYSTEM AND METHODS OF USING SAME

(71) Applicant: LONGYEAR TM, INC., Salt Lake City, UT (US)

(72) Inventors: Thorsten Upmeier, Schlitz (DE); Christof Kruse, Wenden (DE); Stefan Wrede, Kirchhundem (DE); Rene Maennel, Schonbrunn (DE)

(73) Assignee: LONGYEAR TM, INC., Salt Lake City, UT (US)

( * ) Notice: Subject to any disclaimer, the term of this patent is extended or adjusted under 35 U.S.C. 154(b) by 0 days.

(21) Appl. No.: 16/506,444

(22) Filed: Jul. 9, 2019

(65) Prior Publication Data

US 2020/0024098 A1 Jan. 23, 2020

Related U.S. Application Data

(63) Continuation of application No. 15/311,592, filed as application No. PCT/US2015/031752 on May 20, 2015, now Pat. No. 10,384,907.

(60) Provisional application No. 62/000,725, filed on May 20, 2014.

(51) Int. Cl.

| | |
|---|---|
| ***E21B 19/00*** | (2006.01) |
| ***B65H 57/14*** | (2006.01) |
| ***E21B 7/02*** | (2006.01) |
| ***E21B 19/22*** | (2006.01) |
| ***B65H 57/26*** | (2006.01) |
| ***E21B 3/04*** | (2006.01) |

(52) U.S. Cl.

CPC ..... *B65H 57/14* (2013.01); *B65H 57/26* (2013.01); *E21B 3/04* (2013.01); *E21B 7/02* (2013.01); *E21B 19/008* (2013.01); *E21B 19/22* (2013.01); *E21B 7/023* (2013.01)

(58) Field of Classification Search

CPC combination set(s) only.

See application file for complete search history.

(56) References Cited

U.S. PATENT DOCUMENTS

| | | | | |
|---|---|---|---|---|
| 3,401,749 A * | 9/1968 | Daniel | E21B 33/068 | 166/384 |
| 3,690,136 A * | 9/1972 | Slator | B21C 47/18 | 72/160 |
| 4,945,938 A * | 8/1990 | Ponsford | B60P 3/035 | 137/15.01 |
| 5,522,581 A * | 6/1996 | Kulhavy | B66D 3/18 | 188/185 |

* cited by examiner

*Primary Examiner* — Cathleen R Hutchins
*Assistant Examiner* — Ronald R Runyan
(74) *Attorney, Agent, or Firm* — Ballard Spahr LLP

(57) ABSTRACT

A wireline system for use during drilling operations. The wireline system has a wireline assembly and a roller assembly. Both the wireline assembly and the roller assembly are positioned within a front portion of a drill rig.

15 Claims, 17 Drawing Sheets

WIRELINE SYSTEM AND METHODS OF USING SAME

CROSS-REFERENCE TO RELATED APPLICATIONS

This application is a continuation of U.S. application Ser. No. 15/311,592, filed Nov. 16, 2016, which is a National Phase Application of International Application No. PCT/US2015/031752, filed May 20, 2015, which claims priority to and the benefit of the filing date of U.S. Provisional Patent Application No. 62/000,725, filed May 20, 2014, which is incorporated herein by reference in its entirety.

FIELD

This invention relates to a wireline system for use during drilling operations.

BACKGROUND

Conventional drilling systems that utilize wireline cables include wireline assemblies that are positioned either behind the mast of the drilling system or to the side of the mast (for example, when working at variable heights). These systems provide poor visibility of the wireline system and generally do not adequately prevent twisting of the wireline cable during operation. Often, conventional wireline drilling systems are difficult to service in the field and lack desired reliability.

Thus, there is a need in the pertinent art for wireline drilling systems and methods that provide one or more of improved wireline visibility, improved wireline control, improved serviceability, and improved reliability.

SUMMARY

Described herein, in one aspect, is a wireline system for use on a drill rig. The drill rig can comprise a drilling system, and the drilling system can comprise a mast, a drill string, and a drill head configured to impart rotation to the drill string within a drilling formation. The mast can have a longitudinal axis and opposed first and second ends. The first end of the mast can be configured for positioning proximate the drilling formation. The drill head can optionally be configured for selective movement relative to the longitudinal axis of the mast. The drilling system can have a first transverse axis and a second transverse axis extending perpendicularly relative to the first transverse axis. When the mast is in a substantially vertical position, the first and second transverse axes can be substantially perpendicular to the longitudinal axis of the mast. The first transverse axis divides the drill rig into a front portion and a back portion, and the second transverse axis extends from the front portion of the drill rig to the back portion of the drill rig.

In another aspect, the wireline system can comprise a wireline assembly operatively secured to the mast at a first axial location relative to the longitudinal axis of the mast. The first axial location can be proximate the first end of the drill mast. The wireline assembly can comprise a drum configured for engagement with a drilling cable.

In an additional aspect, the wireline system can further comprise a roller assembly operatively secured to the mast at a second axial location relative to the longitudinal axis of the mast. The second axial location can be positioned between the first axial location and the second end of the mast relative to the longitudinal axis of the mast. The roller assembly can be configured for engagement with the drilling cable. The wireline assembly and the roller assembly can be positioned within the front portion of the drill rig, and at least a portion of the wireline assembly and at least a portion of the roller assembly can be axially spaced from the mast relative to the second transverse axis.

In a further aspect, disclosed herein is a drilling system for conducting drilling operations within a drilling formation. The drilling system can be positioned on a drill rig. The drilling system can comprise a mast, a drill string, a drill head, a wireline assembly, and a roller assembly.

In still a further aspect, disclosed herein is an exemplary tilting sled for adjusting the angular position of a drill head on the mast. The tilting sled can optionally be used with a drilling system as disclosed herein.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE FIGURES

These and other features of the preferred embodiments of the invention will become more apparent in the detailed description in which reference is made to the appended drawings wherein:

FIG. 7B is an end view of the roller assembly of FIG. 7A. FIG. 7C is an isolated perspective view of a drilling cable positioned within a groove defined by a sheave of the roller assembly, as disclosed herein. FIG. 7D is an isolated cross-sectional view of bearings that surround a connector of the roller assembly, as disclosed herein.

FIG. 9 depicts the wireline assembly with a motor in place, whereas FIG. 10 does not depict the motor.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a roller" can include two or more such rollers unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Figure 1A:
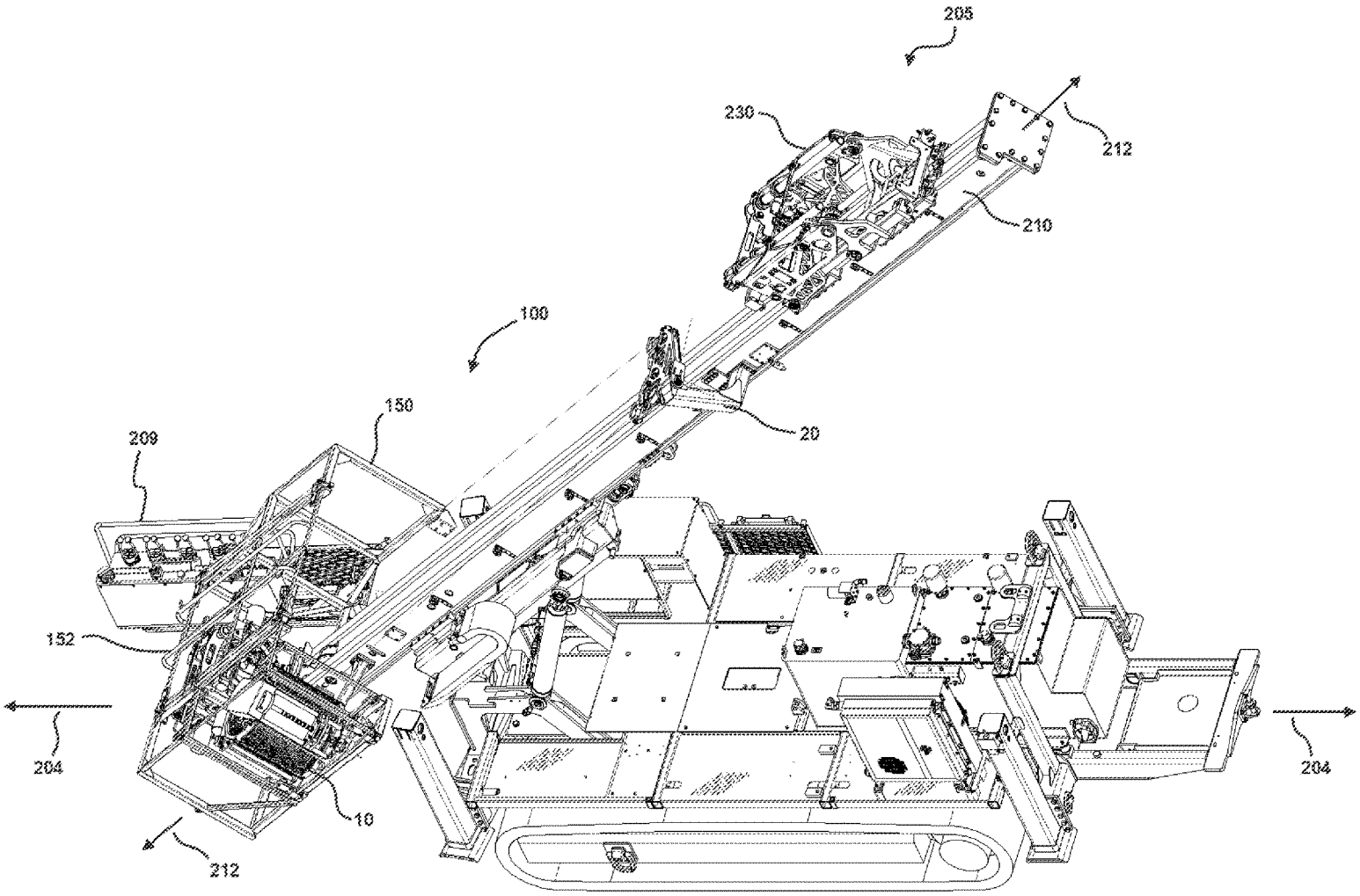
FIG. 1A shows a perspective view of a drill rig comprising an exemplary drilling system as disclosed herein.
Figure 1B:
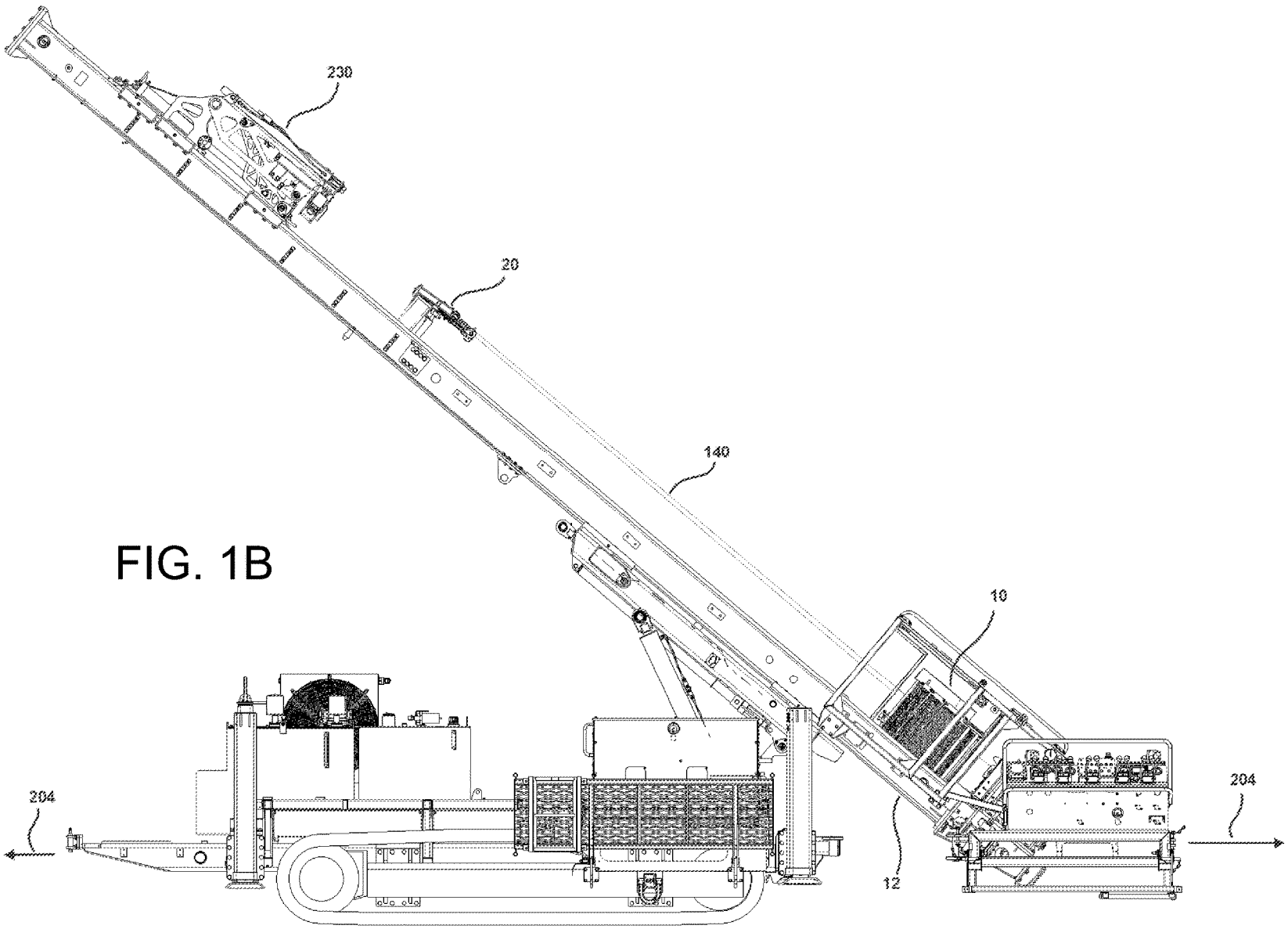
FIG. 1B shows a left side view of the drill rig of FIG. 1A.
Figure 1C:
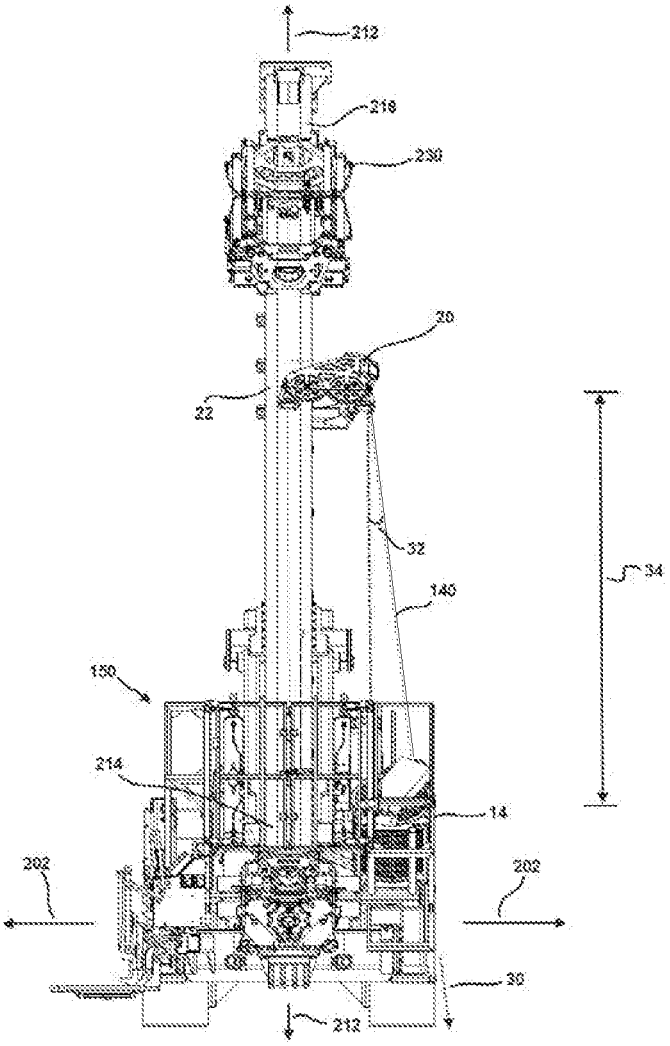
FIG. 1C shows a front view of the drill rig of FIG. 1A.
Figure 2:
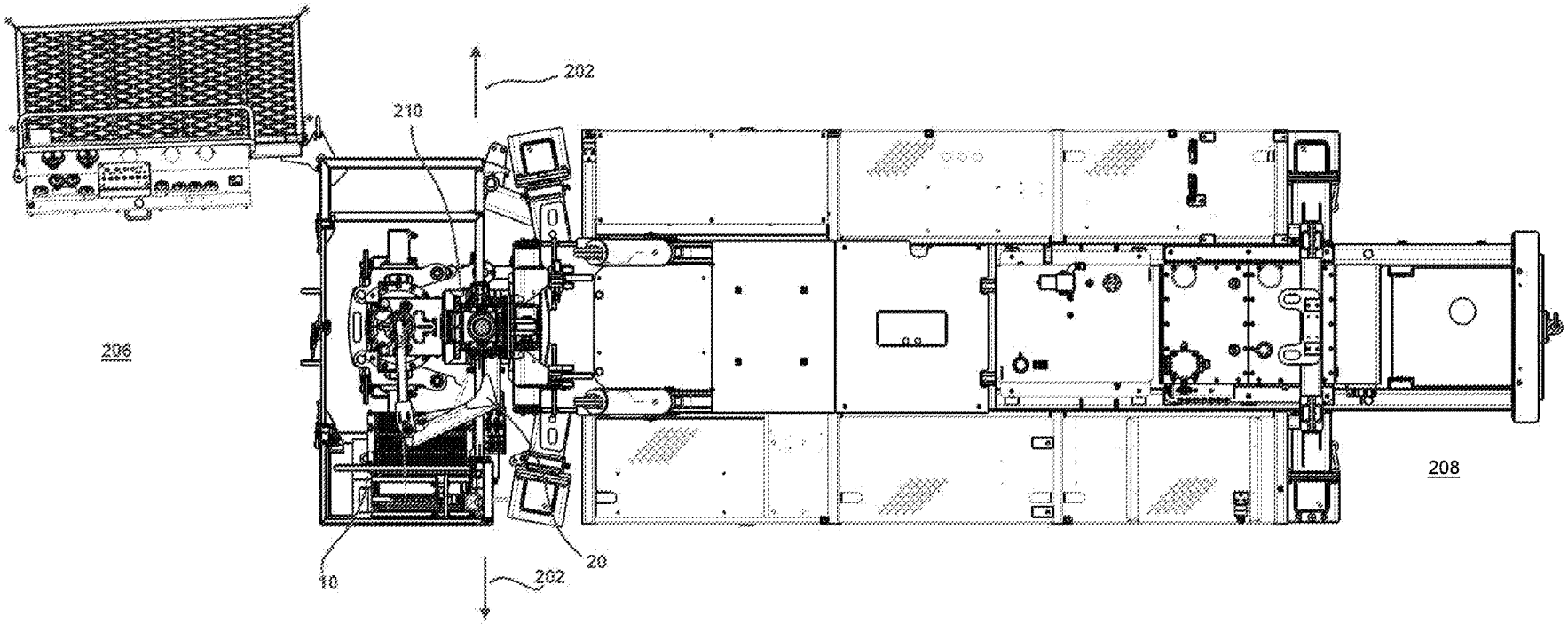
FIG. 2 shows a top view of a drill rig comprising an exemplary drilling system with a mast in a vertical position, as disclosed herein.

Described herein with reference to FIGS. 1A-11 is a wireline system 100 for use on a drill rig 200. The drill rig 200 can comprise a drilling system 205, which can comprise a mast 210, a drill string 220, and a drill head 230 configured to impart rotation to the drill string within a drilling formation. The mast 210 can have a longitudinal axis 212 and opposed first and second ends 214, 216, with the first end of the mast being configured for positioning proximate the drilling formation. The drill head 230 can be optionally be configured for selective movement relative to the longitudinal axis 212 of the mast 210. The drill rig 200 can have a first transverse axis 202 and a second transverse axis 204 extending perpendicularly relative to first transverse axis. When the mast 210 is positioned in a vertical position, as shown in FIG. 2, it is contemplated that the first and second transverse axes 202, 204 can be substantially perpendicular to the longitudinal axis 212 of the mast. The first transverse axis 202 divides the drill rig 200 into a front portion 206 and a back portion 208, and the second transverse axis 204 extends from the front portion of the drill rig to the back portion of the drill rig. In exemplary aspects, the wireline system 100 can comprise a wireline assembly 10 and a roller assembly 20.

In operation, the drilling system 205 can rotate and feed the drill string into the drilling formation. The drilling system 205 can further comprise a foot clamp 207 as is conventionally known in the art. Optionally, the foot clamp 207 can be provided in association with a breaker and/or wrench. In exemplary aspects, the drilling system 205 can comprise a control panel 209 positioned in the front portion 206 of the drill rig 200, from which drilling functions are controlled. As further disclosed herein, the rotary drill head 230, the foot clamp 207 and other moving parts of the drilling system 205 can be secured within a safety cage 150 during drilling. It is contemplated that the drilling system 205 can optionally switch into lower power (rpm, rotation, feed) settings during changing of a drill rod, when at least one door 152 of the safety cage 150 is open. During exploratory drilling operations, the wireline system 100 disclosed herein can be configured to selectively lower and lift up a core barrel relative to the drilling formation using a cable 140. As is conventional in the art, the core barrel can collect a core sample of the drilling formation for geological analysis. In exemplary aspects, the roller assembly 20 can be operatively associated with the wireline assembly 10 and, optionally, can be crown block mounted on an upper portion of the mast 210. As further disclosed herein, the wireline system 100 can generally be positioned within the front portion 206 of the drill rig 200, thereby improving the visibility of the wireline system from the perspective of a drill operator positioned proximate the control panel 209. During deep drilling operations, it is contemplated that the wireline system 100 can be configured to run at a high speed and in a precise manner.

In one aspect, the wireline assembly 10 of the wireline system 100 can be operatively secured to the mast 210 at a first axial location 12 relative to the longitudinal axis 212 of the mast. In this aspect, the first axial location 12 can be proximate the first end 214 of the drill mast 210. In exemplary aspects, the wireline assembly 10 can comprise a drum 14 configured for engagement with the drilling cable 140.

In another aspect, the roller assembly 20 of the wireline system 100 can be operatively secured to the mast 210 at a second axial location 22 relative to the longitudinal axis 212 of the mast 210. In this aspect, the second axial location 22 can be positioned between the first axial location 12 and the second end 216 of the mast 210 relative to the longitudinal axis 212 of the mast. In operation, the roller assembly 20 can be configured for engagement with the drilling cable 140. In exemplary aspects, the wireline assembly 10 and the roller assembly 20 can be positioned within the front portion 206 of the drill rig 200, and at least a portion of the wireline assembly and at least a portion of the roller assembly can be axially spaced from the mast 210 relative to the second transverse axis 204.

In operation, it is contemplated that the drill head 230 can positioned at a top position relative to the longitudinal axis 212 of the mast 210. It is further contemplated that, when the drill head 230 is positioned at the top position, the roller assembly 20 can be positioned between the wireline assembly 10 and the drill head 230 relative to the longitudinal axis 212 of the mast 210.

In exemplary aspects, at least a portion of the wireline assembly 10 and at least a portion of the roller assembly 20 can be axially spaced from the mast 210 and the drill head 230 in either direction relative to the first transverse axis 202, provided at least a portion of the wireline assembly 10 and at least a portion of the roller assembly 20 are positioned within the front portion 206 of the drill rig 200. In these aspects, the wireline assembly 10 and the roller assembly 20 can be substantially axially aligned along an axis 30. Optionally, it is contemplated that the axis 30 can extend at a selected angle 32 relative to the longitudinal axis 212 of the mast 210. In some exemplary aspects, the selected angle 32 can be a selected acute angle, such as, for example and without limitation, an acute angle ranging from about 5 degrees to about 60 degrees. Alternatively, in other optional aspects, the axis 30 can extend substantially parallel to the longitudinal axis 212 of the mast 210. In further exemplary aspects, and with reference to FIG. 1C, it is contemplated that the axis 30 can substantially correspond to the axial pathway of the cable 140 between the wireline assembly 10 and the roller assembly 20.

In additional aspects, the wireline assembly 10 can comprise a base portion 17 and opposed first and second support brackets 18*a*, 18*b*. In these aspects, it is contemplated that the drum 14 can be positioned between the first and second support brackets 18*a*, 18*b*. In further aspects, the drum 14 can have a rotational axis 15 and define an interior chamber 16 extending axially relative to the rotational axis. In still further aspects, the wireline system 100 can further comprise a hydraulic motor 40. Optionally, in these aspects, the hydraulic motor 40 can be positioned at least partially within the interior chamber 16 of the drum 14 and operatively coupled to the drum. Upon activation of the hydraulic motor 40, the drum 14 can be configured to rotate about the rotational axis 15 relative to the first and second support brackets 18*a*, 18*b*. In exemplary aspects, the first and second support brackets 18*a*, 18*b* can optionally define respective openings 19*a*, 19*b* positioned in communication with the interior chamber 16 of the drum 14.

Figure 4:
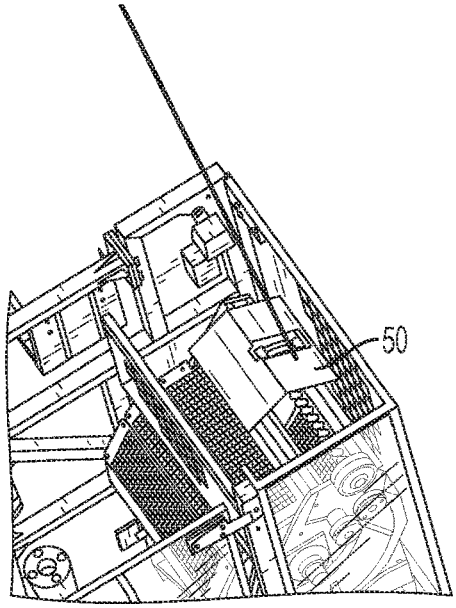
FIG. 4 is a perspective view of an exemplary spooling assembly as disclosed herein.
Figure 5:
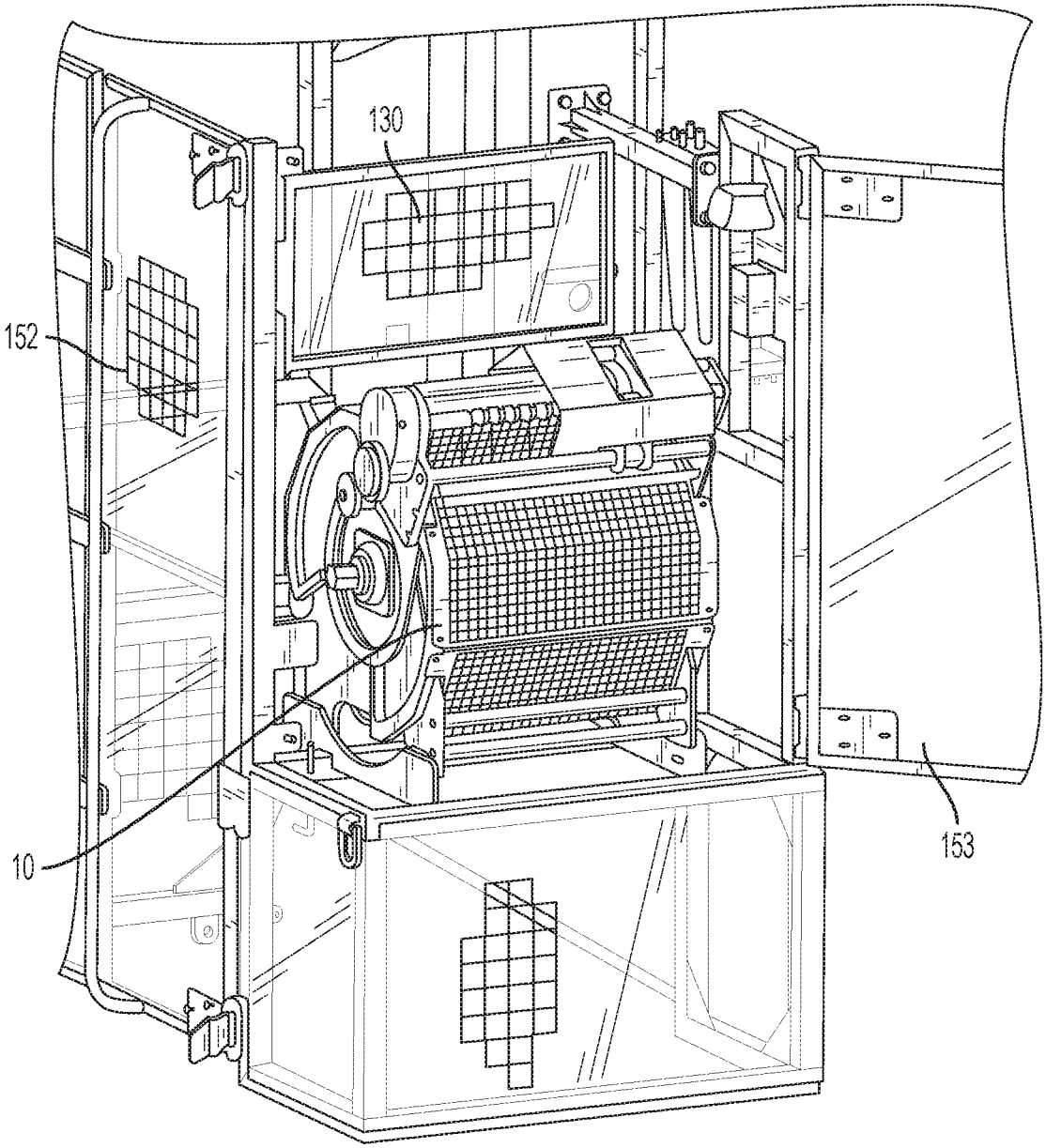
FIG. 5 is an isolated perspective view of an exemplary safety cage and wireline assembly, showing a secondary door for accessing the wireline assembly.
Figure 8:
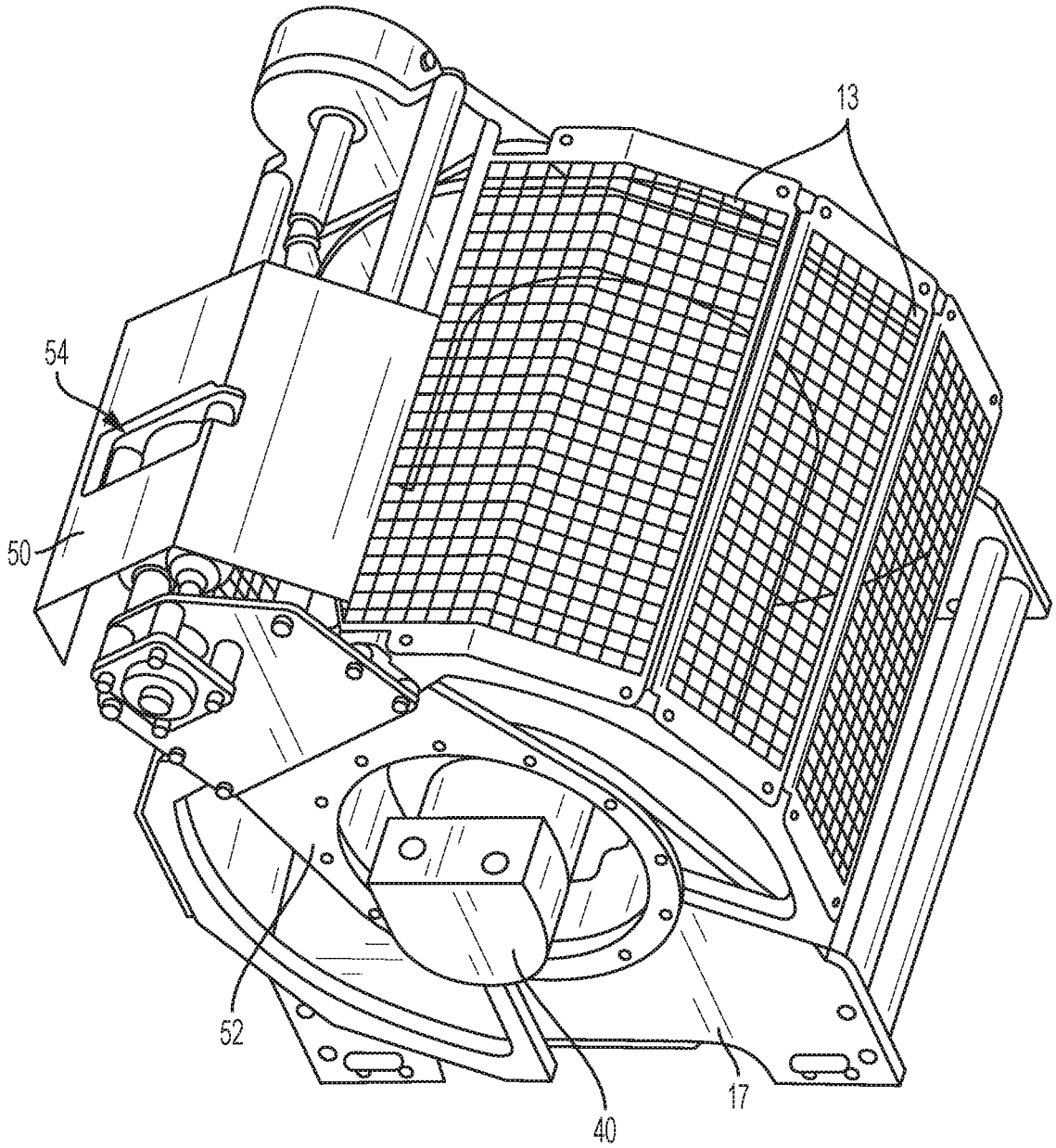
FIG. 8 is a perspective view of an exemplary wireline assembly as disclosed herein.

In another aspect, and with reference to FIGS. 4 and 8, the wireline system 100 can further comprise a spooling device 50. In this aspect, the spooling device 50 can be configured to receive the drilling cable 140 from the drum 14 and direct the drilling cable to the roller assembly 20. The spooling device 50 can be further configured to guide the drilling cable 140 to ensure winding and unwinding of the cable. In exemplary aspects, the spooling device 50 can comprise a mounting bracket 52 secured to the first and second support brackets 18*a*, 18*b*. In these aspects, it is contemplated that the mounting bracket 52 can optionally define an opening 54 in communication with the interior chamber 16 of the drum 14. It is further contemplated that the wireline assembly 10 can comprise a safety guard 130 that is configured to restrict access to the spooling device 50 and the drilling cable 140 during operation of the drilling system 205. In exemplary aspects, the spooling device and the drum 14 can be supported by the base portion 17 of the wireline assembly 10. In these aspects, the base portion 17 can optionally comprise at least two pairs of opposing legs that are connected together by cross bars as shown in FIG. 8.

Figure 3:
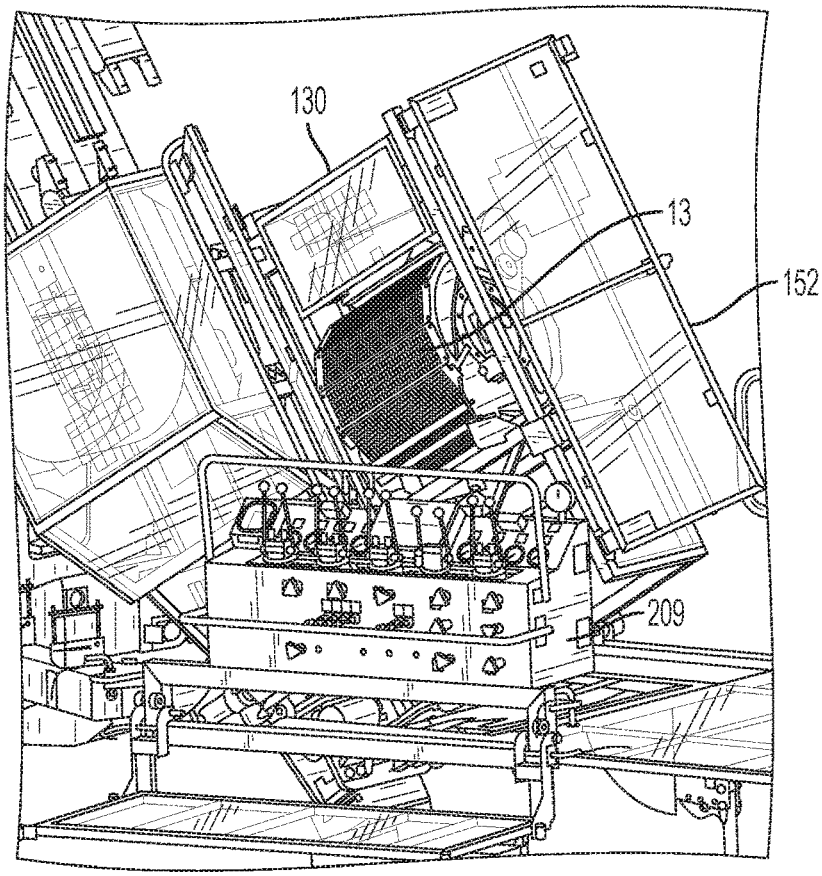
FIG. 3 is a perspective view of a safety cage and control panel of an exemplary drilling system, as disclosed herein.

The wireline assembly 10 can be mounted to the first end 214 of the mast using at least one support bracket 11. The at least one support bracket can optionally be configured to support the safety cage 150. The wireline assembly 10 can optionally comprise at least one protective mesh element 13 that circumferentially surrounds at least a portion of the drum 14. Optionally, in some aspects, the safety cage 150 can be positioned to enclose at least a portion of the drum 14, including portions of the drum that are not surrounded by the at least one protective mesh element 13. In exemplary aspects, the safety cage 150 can be provided with at least one door 152 that permits selective access to the wireline system 100. In these aspects, it is contemplated that the at least one door 152 can be selectively opened to permit efficient servicing and maintenance of the wireline system 100. When one or more doors 152 of the safety cage 150 are opened, as shown in FIG. 3, free access to the drill string and the core barrel assembly are provided. It is contemplated that each door 152 of the safety cage 150 can be configured to open by about 180°. It is further contemplated that once a drill operator enters the safety cage 150 through the at least one door 152, the drill operator is protected against injury by the protective mesh element 13 and the safety guard 130. In further exemplary aspects, and with reference to FIG. 5, it is contemplated that the safety cage 150 can comprise at least one secondary access door 153 that provides access to the wireline assembly 10 from outside the safety cage.

In operation, because the drilling cable 140 is positioned in the front portion 206 of the drill mast 200, it is contemplated that the drilling cable (including portions moving in an upward direction and portions moving in a downward direction) can be freely visible by an operator positioned proximate the control panel 209. In operation, because both the wireline assembly 10 and the roller assembly 20 are mounted to the mast 210, it is further contemplated that an axial distance 34 between the wireline assembly and the roller assembly relative to the longitudinal axis 212 of the mast can remain substantially constant. The consistency of this axial distance 34 can protect against damage to components of the drilling system 100 and avoid the need for additional securing measures when the drilling system is positioned in angled or transport positions. More particularly, in conventional wireline systems, in which the wireline assembly and the roller assembly are not both mounted to the mast, the distance between the wireline assembly and the roller assembly and the operative length of the cable are varied according to a dump function of the mast, the angle of drilling (e.g., 90° to 45°), and the transport position. In contrast, during initial setup of the drill rig 200 disclosed herein, additional checking of the wireline assembly 10, roller assembly 20, and drilling cable 140 is not required. In exemplary aspects, it is contemplated that the axial distance 34 between the between the wireline assembly 10 and the roller assembly 20 can be over 4 m and thereby creates a soft run within the roller assembly. In these aspects, it is further contemplated that the soft run can be created by positioning the mounting bracket 52 such that the opening 54 of the mounting bracket is angled to receive the drilling cable at the selected angle 32.

In operation, the spooling device 50 can be configured for selective rotation relative to the drum 14. In exemplary aspects, and with reference to FIGS. 9-10, the wireline assembly 10 can further comprise a connection housing 60 positioned within the drum 14. In these aspects, the connection housing 60 can be operatively coupled to the first support bracket 18*a*. In additional aspects, the connection housing 60 can be configured to receive at least a portion of the hydraulic motor 40. In these aspects, the connection housing 60 can optionally define a projection 62 that extends circumferentially within the connection housing and is configured to support the hydraulic motor 40 in an operative position. In further exemplary aspects, the drum 14 can comprise a shaft 70, a central hub 72, a first inner wall 74, and a second inner wall 76. In these aspects, it is contemplated that the wireline assembly 10 can further comprise a support flange 80. It is further contemplated that the central hub 72 can be secured to the first inner wall 74, which can be positioned between the first and second support brackets 18*a*, 18*b* relative to the rotational axis 15. It is still further contemplated that the projection 62 of the connection housing 60 can be secured to the first inner wall 74 to thereby radially surround the central hub 72. In this position, the central hub 72 can be configured for operative engagement with the hydraulic motor 40. In operation, the second support bracket 18*b* can be configured to support the support flange 80. In exemplary aspects, the support flange 80 can define a central opening 82 configured to receive the shaft 70 of the drum 14. In these aspects, the shaft 70 of the drum 14 can be secured to the second inner wall 76, and it is contemplated that the support flange 80 can be configured to support the shaft 70 of the drum 14 in substantial axial alignment with the central hub 72 relative to the rotational axis 15. It is contemplated that, upon operative engagement between the central hub 72 of the drum 14 and the hydraulic motor 40, the central hub of the drum can be configured to receive a rotational force from the hydraulic motor and to impart the rotational force to the drum. In further exemplary aspects, the wireline assembly 10 can further comprise a bearing 84 supported by the support flange 80 and surrounding at least a portion of the shaft 70 of the drum 14. In these aspects, it is contemplated that the support flange 80 can be configured to support the bearing 84 when it surrounds and supports the shaft 70 of the drum 14. In exemplary aspects, the support flange 80 can optionally define a viewing window spaced from the central opening 82 that permits viewing of the cable connection to the drum 14, as further described herein. It is contemplated that the shaft 70 of the drum 14 can be screwable into the bearing 84.

Figure 9:
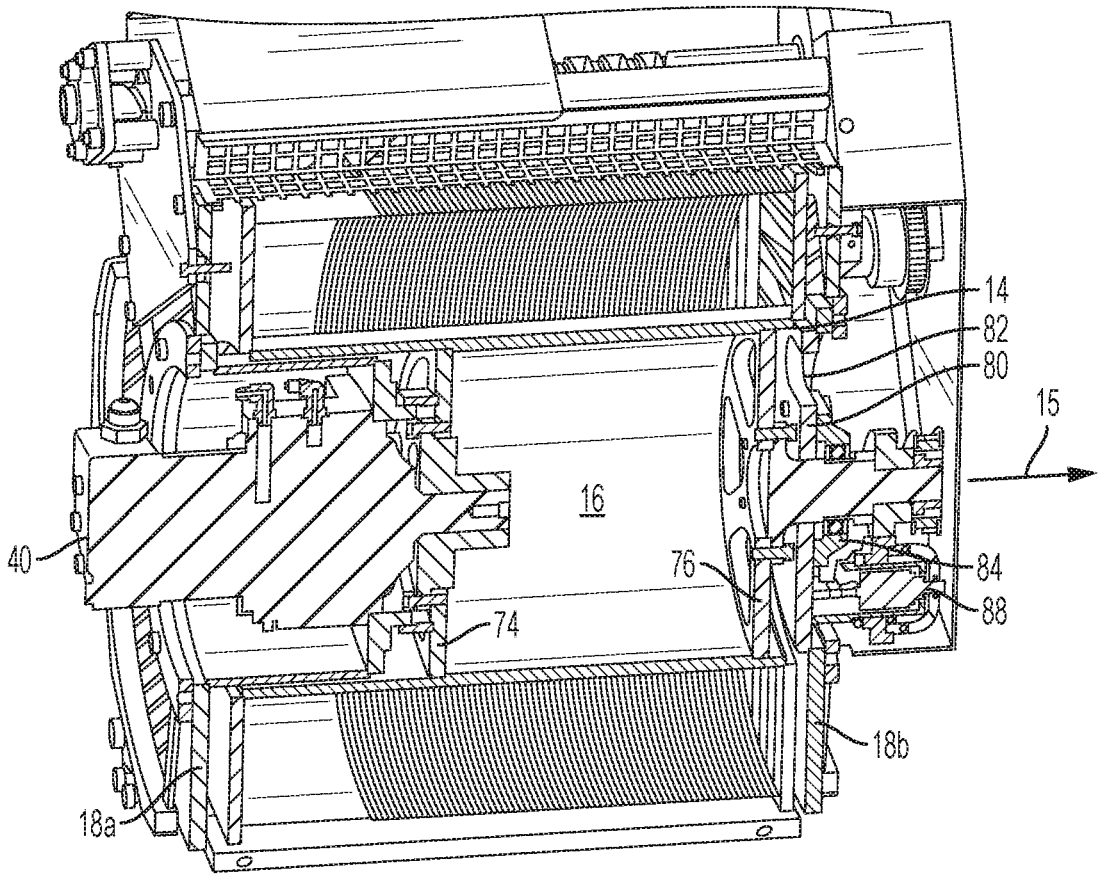
FIGS. 9-10 are cross-sectional views of an exemplary wireline assembly as disclosed herein.
Figure 10:
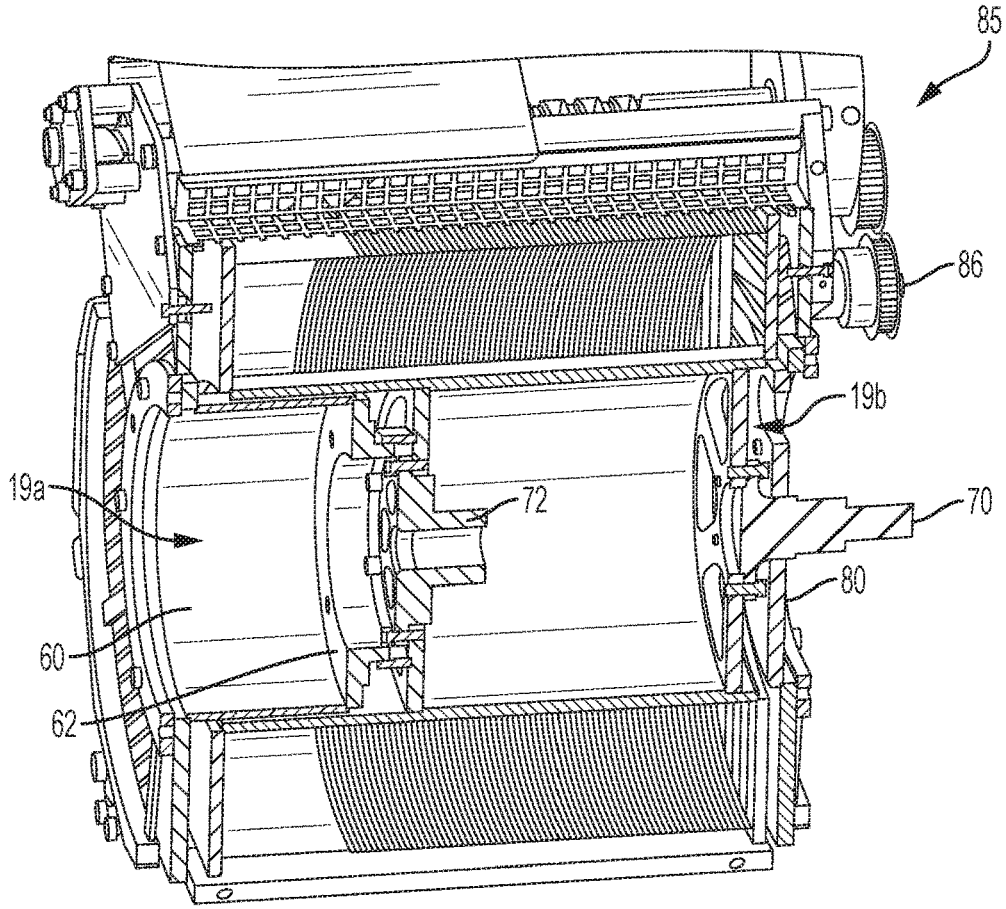

In exemplary aspects, and with reference to FIGS. 8-10, the mounting bracket 52 of the spooling device 50 can optionally be operatively rotationally coupled to the first and second support brackets 18*a*, 18*b* using a pitch circle, which permits rotation of the mounting bracket (and the spooling device) in accordance with a hole pattern defined in the pitch circle. In exemplary aspects, each sequential hole of the pitch circle can correspond to a 30° step. In further exemplary aspects, it is contemplated that the mounting bracket 52 of the spooling device 50 can be secured to the at least one protective mesh element 13 such that the protective mesh elements rotate with the mounting bracket 52 and spooling device 50. In operation, it is contemplated that the spooling device 50 and the protective mesh elements 13 can be rotated about and between at least three rotational positions, including for example, a centered position, a left position, and a right position. FIG. 8 shows an exemplary left rotational position. It is contemplated that the center rotational position can generally correspond to a position in which the spooling device 50 is oriented substantially parallel to axis 212. It is further contemplated that the left and right rotational positions can correspond to positions in which the spooling device is angularly oriented relative to axis 212. In further exemplary aspects, it is contemplated that the at least one protective mesh element 13 can comprise lower protective elements that can be selectively removed and positioned on a different portion of the wireline assembly 10 when the spooling device is not in the centered position. It is contemplated that this selective adjustability of the configuration of the protective mesh elements 13 can permit usage of the wireline assembly 10 with other drill rigs and also permit usage of the wireline assembly 10 in angled drilling applications. In particular, due to the variability of the spooling device 50, protective elements 13, and the cable connection in the drum 14 (as further described herein), it is contemplated that the drum can be turned by up to 180° to achieve a better hydraulic connection for different placements and/or angled drilling.

In exemplary aspects, and as shown in FIG. 10, the central hub 72 and the hydraulic motor 40 can be selectively replaceable. In these aspects, it is contemplated that a first hydraulic motor can be selectively replaced with a second hydraulic motor. It is further contemplated that a first central hub that is compatible with (e.g., sized and shaped for complementary interaction with) the first hydraulic motor can be selectively replaced with a second central hub that is compatible with (e.g., sized and shaped for complementary interaction with) the second hydraulic motor.

In other exemplary aspects, and with reference to FIG. 10, the wireline assembly can further comprise a drive belt 85 operatively coupled to the shaft 70 of the drum and to the spooling device 50. In these aspects, the drive belt 85 can be configured to impart rotational movement to the spooling device 50 as the shaft 70 of the drum 14 rotates relative to the rotational axis 15. Optionally, it is contemplated that the drive belt 85 can comprise a plurality of interlinking belt gears 86. In additional aspects, the spooling device 50 can have an adjustable spooling rate. In these aspects, the spooling rate can be selectively adjusted by varying a gear ratio between at least one pair of interlinking belt gears 86. One skilled in the art will appreciate that this can allow or accommodate for a change to different wire diameters.

In operation, the shaft 70 of the drum 14 can create movement using the drive belt 85, which can optionally give the rotational impulse by a 1:1 ratio to a rotational sensor 88, such as, for example and without limitation, a CAN Sensor, to determine an RPM count. It is contemplated that tight clearances can be provided between the projection 62 and the first inner wall 74 and/or central hub 72 and between the shaft 70 and the support flange 80.

Figure 11:
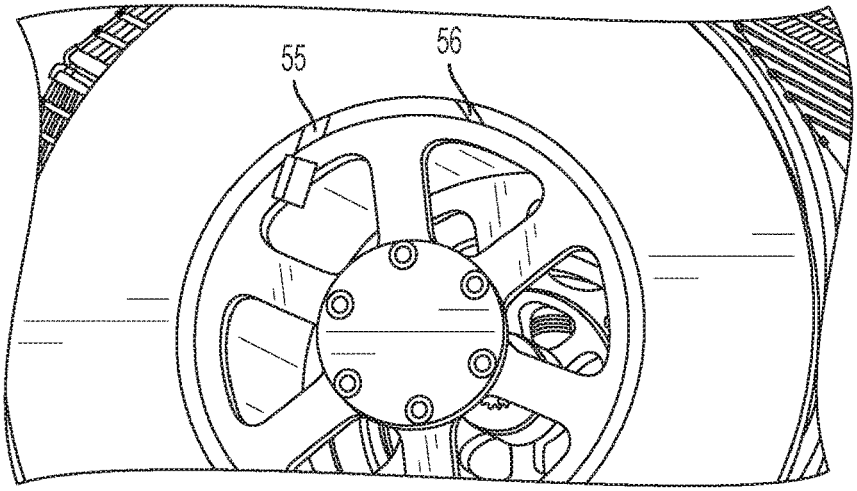
FIG. 11 is an isolated side view of the drum of an exemplary wireline assembly, as disclosed herein.

In further aspects, during operation of the wireline system 100, it is contemplated that the cable 140 can be spooled to the drum 14 in either direction. In these aspects, it is contemplated that connection holes 55, 56 for the cable 140 can be configured to receive a cable being spooled in either direction. Optionally, as shown in FIG. 11, the connection holes 55, 56 can correspond to angled cut outs formed in the second support bracket 18*b*.

In additional exemplary aspects, and with reference to FIGS. 6A-7D, the roller assembly 20 can optionally comprise a support arm 24 and a pivot joint 26 operatively coupled to the support arm and configured for selective pivotal movement relative to the support arm. In these aspects, the support arm 24 can be operatively secured to the mast 210 at the second axial location 22, preferably on a side portion of the mast that extends between front and back sides of the mast (i.e., a left or right side of the mast). In further aspects, the roller assembly 20 can comprise opposed first and second sheaves 90*a*, 90*b* and a bracket 96 operatively secured to the pivot joint 26. In these aspects, the first and second sheaves 90*a*, 90*b* can each define a respective circumferential groove 92*a*, 92*b* and be configured for rotation about a respective rotational axis 94*a*, 94*b*. It is contemplated that the circumferential groove 92*a*, 92*b* of each sheave 90*a*, 90*b* can be configured to receive the wireline cable 140. It is further contemplated that the bracket 96 can be configured to engage the first and second sheaves 90*a*, 90*b* such that the rotational axes 94*a*, 94*b* of the first and second sheaves are substantially parallel to one another and substantially perpendicular to the longitudinal axis 212 of the mast 210. In exemplary aspects, and with reference to FIGS. 6A-6B, the bracket 96 can comprise first and second lightweight portions, with the first portion defining at least one hole configured to receive a first connector 91*a* and the second portion defining at least one hole configured to receive a second connector 91*b*. In these aspects, it is contemplated that the first connector 91*a* can be configured to couple the first sheave 90*a* to the first portion of the bracket 96, whereas the second connector 91*b* can be configured to couple the second sheave 90*b* to the second portion of the bracket. Optionally, in some aspects, the bracket 96 can be operatively coupled to the pivot joint 26 by a bolt or other fastener as is known in the art. Optionally, in other aspects, the first and second connectors 91*a*, 91*b* can be bolts or other fasteners as are known in the art. In further optional aspects, it is contemplated that the bracket 96 can be provided with bearings 126 that circumferentially surround at least a portion of the first and second connectors 91*a*, 91*b*.

Figure 7A:
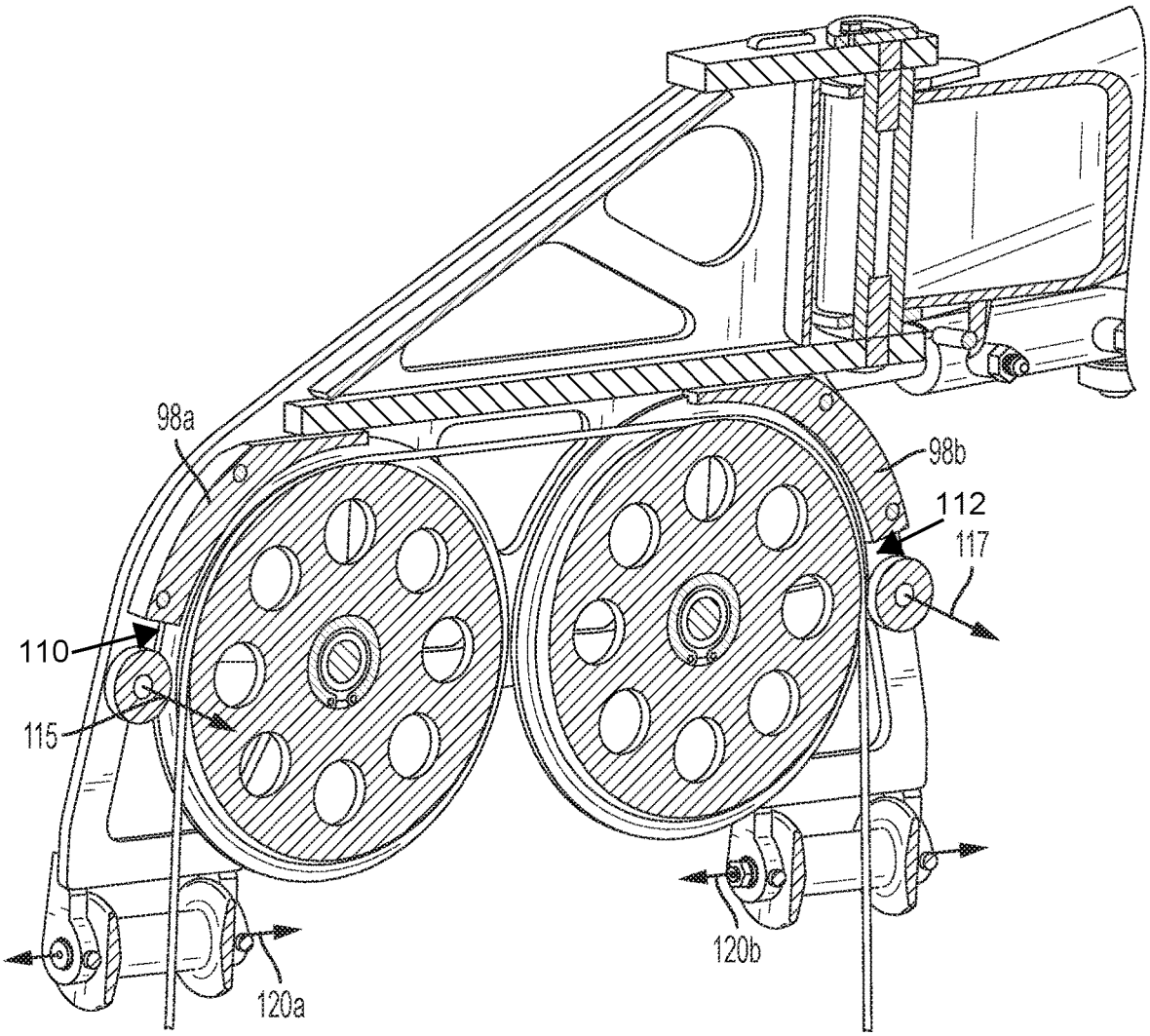
FIG. 7A is a cross-sectional perspective view of an exemplary roller assembly as disclosed herein.
Figure 7B:
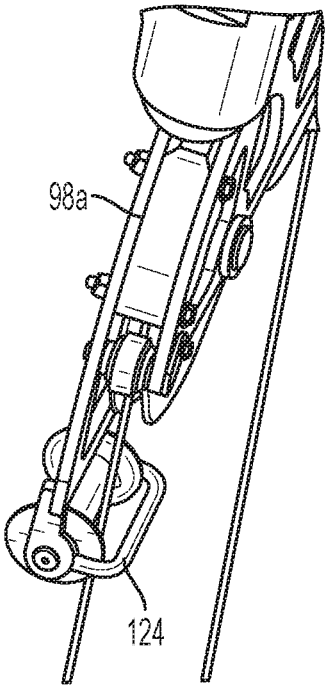
FIGS. 7B-7D are various perspective views of portions of the roller assembly of FIG. 7A.
Figure 7C:
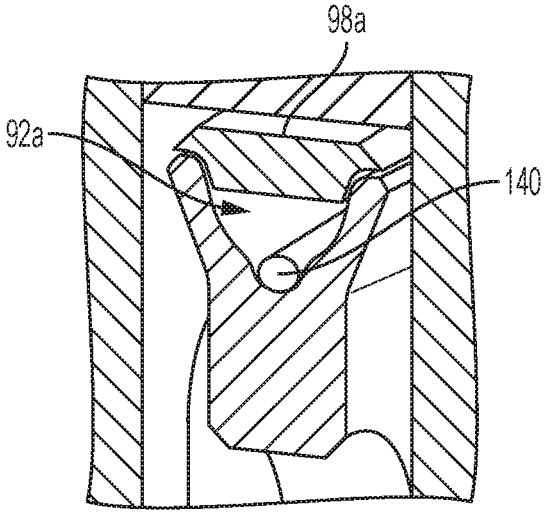
Figure 7D:
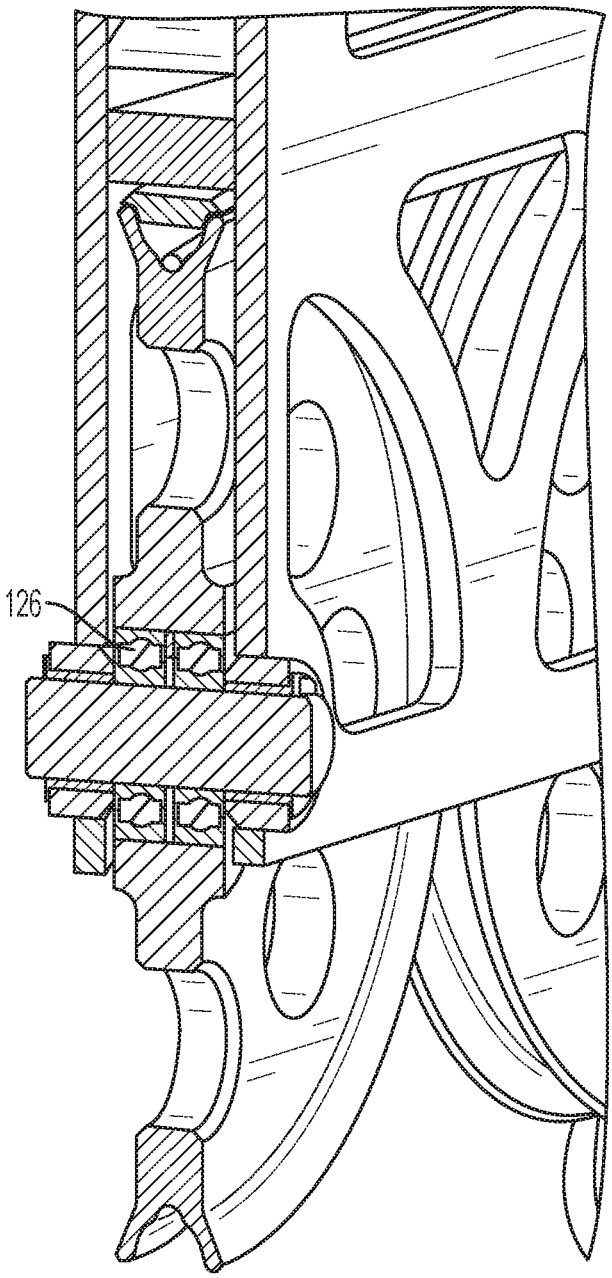

Optionally, in some exemplary aspects, and with reference to FIG. 7A, the roller assembly 20 can comprise opposed first and second guiding plates 98*a*, 98*b*. In these aspects, the first and second guiding plates 98*a*, 98*b* can be secured to the bracket 96. It is contemplated that the first guiding plate 98*a* can be spaced from and operatively positioned relative to the first sheave 90*a* to prevent the wireline cable 140 from disengaging the circumferential groove 92*a* of the first sheave. Similarly, it is contemplated that the second guiding plate 98*b* can be spaced from and operatively positioned relative to the second sheave 90*b* to prevent the wireline cable 140 from disengaging the circumferential groove 92*b* of the second sheave. It is contemplated that the separation between the guiding plates 98*a*, 98*b* and the sheaves 90*a*, 90*b* can be minimized to ensure that the cable is tightly received between the guiding plates and the sheaves. It is further contemplated that the guiding plates 98*a*, 98*b* can have corresponding, opposite contours relative to the first and second sheaves 90*a*, 90*b*, respectively. In exemplary aspects, the first and second guiding plates 98*a*, 98*b* can comprise plastic.

In further exemplary aspects, and with reference to FIGS. 6A-7A, the first guiding plate 98*a* can optionally cooperate with the circumferential groove 92*a* of the first sheave 90*a* to define an inlet 110 of the roller assembly 20. Similarly, it is contemplated that the second guiding plate 98*b* can cooperate with the circumferential groove 92*b* of the second sheave 90*b* to define an outlet 112 of the roller assembly 20.

In additional, optional aspects, the roller assembly 20 can further comprise at least one inlet roller 114 positioned proximate the inlet 110 of the roller assembly and spaced from the circumferential groove 92*a* of the first sheave 90*a*. In these aspects, the roller assembly 20 can still further comprise at least one outlet roller 116 positioned proximate the outlet 112 of the roller assembly and spaced from the circumferential groove 92*b* of the second sheave 90*b*. In operation, the at least one inlet roller 114 can be configured to guide a wireline cable 140 into the circumferential groove 92*a* of the first sheave 90*a*, and the at least one outlet roller 116 can be configured to guide the wireline cable as it exits the outlet 112 of the roller assembly. In exemplary aspects, it is contemplated that the at least one inlet roller 114 can have a corresponding, substantially opposite contour relative to the circumferential groove 92*a* of the first sheave 90*a*. Similarly, it is contemplated that the at least one outlet roller 116 can have a corresponding, substantially opposite contour relative to the circumferential groove 92*b* of the second sheave 90*b*. Thus, it is contemplated that the circumferential grooves 92*a*, 92*b* of the sheaves 90*a*, 90*b* can extend inwardly (into the sheaves) whereas the contoured surface of the inlet and outlet rollers 114, 116 can extend away from the sheaves. Optionally, in one aspect, the at least one inlet roller 114 and the at least one outlet roller 116 can be configured for rotation about respective rotational axes 115, 117. In this aspect, it is contemplated that the rotational axes 115, 117 of the at least one inlet roller 114 and the at least one outlet roller 116 can be substantially parallel to the rotational axes 94*a*, 94*b* of the first and second sheaves 90*a*, 90*b*. In further aspects, the at least one inlet roller 114 can optionally be configured to constrain movement of the wireline cable 140 relative to the rotational axis 115 of the at least one inlet roller as the wireline cable enters the inlet 110 of the roller assembly. Similarly, it is contemplated that the at least one outlet roller 116 can optionally be configured to constrain movement of the wireline cable 140 relative to the rotational axis 117 of the at least one outlet roller 116 as the wireline cable exits the outlet 112 of the roller assembly.

Optionally, in another exemplary aspect, the roller assembly 20 can further comprise a first guiding roller 118*a* spaced from the inlet 110 of the roller assembly relative to the longitudinal axis 212 of the mast 210 and a second guiding roller 118*b* spaced from the outlet 112 of the roller assembly relative to the longitudinal axis of the mast. In this aspect, the first guiding roller 118*a* can be configured for rotation about a rotational axis 120*a* that is substantially perpendicular to the rotational axes 94*a*. 94*b* of the first and second sheaves 90*a*, 90*b*. It is contemplated that the second guiding roller 118*b* can be configured for rotation about a rotational axis 120*b* that is substantially perpendicular to the rotational axes 94*a*, 94*b* of the first and second sheaves 90*a*, 90*b*. In operation, the first guiding roller 118*a* can be configured to engage the wireline cable 140 to constrain movement of the wireline cable relative to the rotational axis 120*a* of the first guiding roller 118*a* as the wireline cable approaches the inlet 110 of the roller assembly 20. It is further contemplated that the second guiding roller 118*b* can be configured to engage the wireline cable 140 to constrain movement of the wireline cable relative to the rotational axis 120*b* of the second guiding roller 118*b* as the wireline cable exits the outlet 112 of the roller assembly. In exemplary aspects, during "swinging" of the roller assembly, a small difference in an inlet run-angle of the drilling cable 140 can be created. In these aspects, it is contemplated that the first and second guiding rollers 118*a*, 118*b* can be configured to absorb the full range of the cable run-angle at the inlet 110 and outlet 112, thereby permitting guidance of the cable in both directions. In further exemplary aspects, and with reference to FIGS.

6A-7C, each of the first and second guiding rollers 118*a*, 118*b* can comprise a respective bow 124 that cooperates with the corresponding guiding roller to define an opening for receiving the drilling cable 140. In these aspects, the bow 124 can be configured to ensure that the cable 140 remains in operative communication with its associated guiding roller during operation of the drilling system.

It is contemplated that the drilling cable 140 can have a cross-sectional diameter, and that the first and second sheaves 90*a*, 90*b* can have a diameter. In exemplary aspects, it is contemplated that the cross-sectional diameter of the drilling cable 140 can be substantially less than the diameters of the first and second sheaves 90*a*, 90*b*. Optionally, it is contemplated that the ratio between the diameters of the first and second sheaves 90*a*, 90*b* and the cross-sectional diameter of the drilling cable 140 can be up to about 19:1.

Figure 6A:
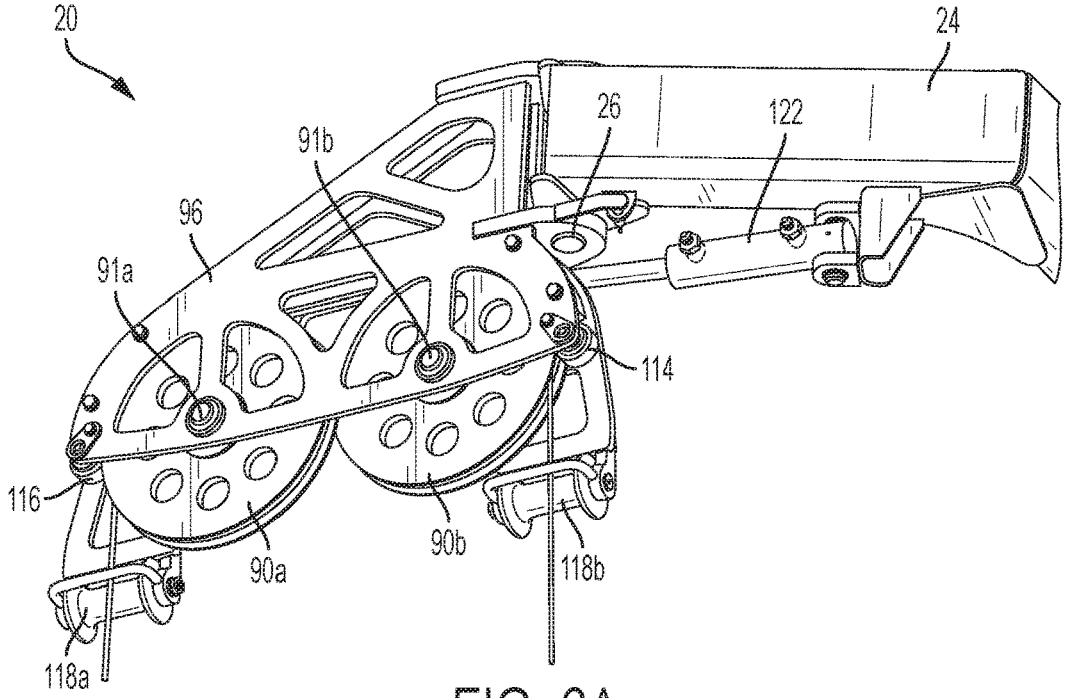
FIGS. 6A-6B provide various perspective views of an exemplary roller assembly as disclosed herein.
Figure 6B:
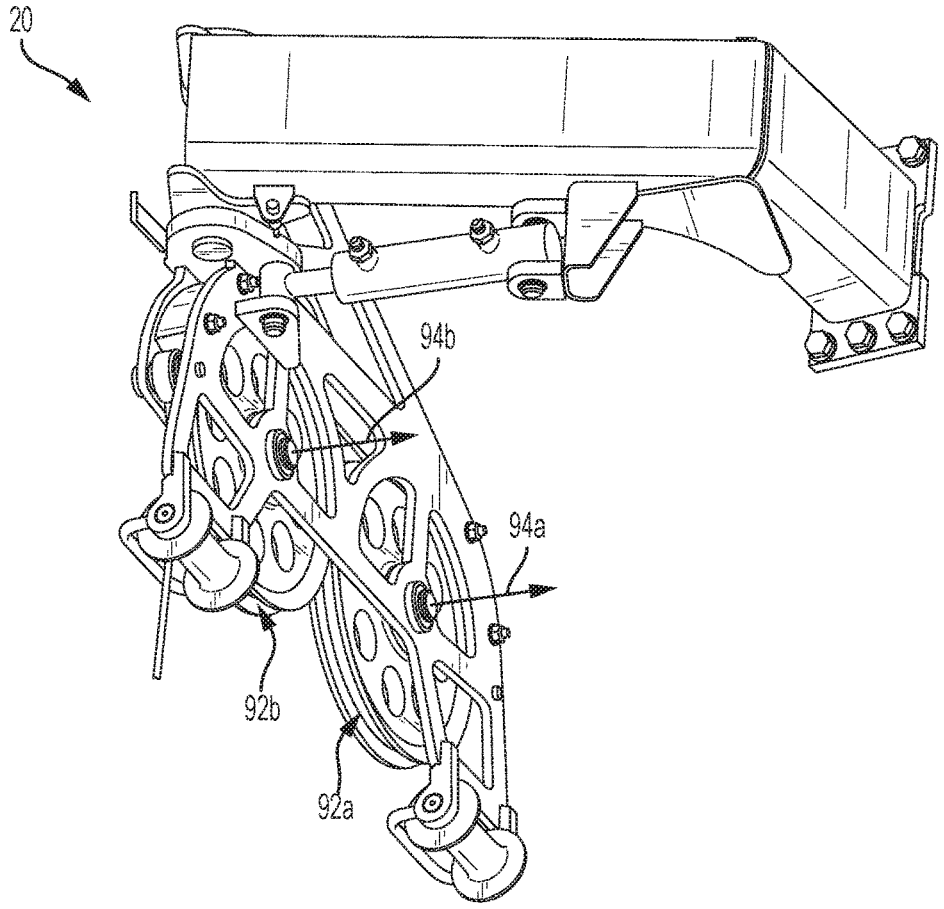

In operation, if the drill head 230 is moved to the top end position of the mast 210, then the roller assembly can slew and/or slide in to the drilling line. It is contemplated that this slew and slide function can be initiated by an actuator 122, which, as shown in FIGS. 6A-6B, can cause the roller assembly to stop in selected positions during the swing in function. Optionally, it is contemplated that the roller assembly and/or the wireline system can be mounted on the left or right side of the mast.

In exemplary aspects, the drilling system 205 can further comprise a sled configured to effect movement of the drill head 230. In these aspects, it is contemplated that the slew-in-function and the movement of the drill head can be interlocked to each other. For example, it is contemplated that the drilling system 205 can be configured such that the sled cannot move when the roller assembly is placed into the drilling line. It is further contemplated that the sled can be configured to only feed the drill head in a downward direction when the roller assembly is positioned in an outer position (opposed from the slew-in position). Optionally, it is contemplated that the drilling system 205 can further comprise a switch that monitors whether the roller assembly is positioned in the outer position so that, unless the switch is activated (indicating that the roller assembly is in the outer position), the sled is not permitted to feed the drill head in a downward direction.

In operation, it is contemplated that the wireline system 100 as disclosed herein can permit easy identification of wireline placement by a drill operator, such as a drill operator positioned in the vicinity of a control panel as disclosed herein. More particularly, it is contemplated that the wireline system 100 disclosed herein can provide good visibility of the drilling cable (in both upward and downward directions), the spooling device, and the wireline assembly.

Moreover, it is contemplated that the wireline system 100 can provide easy access to the components of the system due to low height placement. For example, it is contemplated that the at least one door 152 of the safety cage 150 can allow for easy maintenance of the wireline system components and thereby eliminate the need for working on heights. It is further contemplated that the motor and/or bearing(s) of the wireline assembly 10 can be disassembled without the need for unwinding the drilling cable 140 from the drum 14, which remains supported during such maintenance activities.

It is further contemplated that the improved visibility of the disclosed wireline system and the elimination of risks associated with working on heights can significantly improve the safety of the disclosed system.

During operation, it is still further contemplated that the wireline system can provide for variability in the use and placement of the wireline and roller assemblies. In particular, it is contemplated that the roller assembly and its associated guiding means can be configured to provide optimized guiding of the drilling cable. It is further contemplated that the wireline system can be configured to permit winding of the drilling cable in either direction (left-handed or right-handed). It is still further contemplated that the wireline assembly can permit rotation of the spooling device and the safety guards of the drum by up to 180 degrees to permit optimized hydraulic connection and/or angled drilling using a variety of different rigs. Additionally, it is contemplated that the rotational movement of the spooling device and the safety guards can ensure that the wireline assembly maintains a substantially compact profile.

In further exemplary aspects, it is contemplated that the wireline system as disclosed herein can be configured for operative coupling to a drilling control system as is known in the art. For example, in these aspects, it is optionally contemplated that the rotational sensor mounted within the wireline assembly can be operatively coupled to a processor of a computer that is provided as part of a drilling control system.

Generally, the steps for retrieving core from a formation comprise: stopping the drilling process; disconnecting the drill head from the drill string in the drill hole above the foot clamp, which holds the drill string in place; activating the feed function of the sled to move the drill head to the top end position of the drill mast; swinging and/or sliding the roller assembly into the drilling axis underneath the drill head, thereby activating the interlock system of the drilling system to prevent movement of the drill head; lowering an overshot and the drilling cable into the drill hole until a portion of the overshot engages an upper end of the core barrel; extracting the overshot and the core barrel from the drill hole; when a lower end of the core barrel reaches the upper end of the drill rod that is held within the foot clamp and has about three inches of clearance above the rod, swinging out the wireline crane back to a parked position (spaced outwardly from the drilling axis), thereby disengaging the interlock system and permitting movement of the drill head; lowering the core barrel to a horizontal position on the ground or other supporting device, for example and without limitation, a core pusher device; when the core barrel is securely stored, disconnecting the overshot from the core barrel and placing the overshot in its parked position until the next core drilling sequence is completed; and repeating the preceding steps as necessary until a complete drill run is performed.

With conventional wireline rigs, the wireline winch is typically mounted behind the mast such that a drill operator has no free view of the wireline winch. The wireline winch is operated at a high speed (high drilling cable velocity), with the wireline drum traveling at up to 400 m/min at the top end of the drill hole and up to 150 m/min at the bottom of the drill hole and the average speed being about 275 m/min.

If the overshot hits the surface of the water/mud standing in the hole (the "water table"), the overshot can be slowed down rapidly. In this event, the cable that holds the overshot can lose its tension on the wireline drum, and there is a high risk of tangling of the cable. Such tangling of the cable can lead to cable breaks and/or damaging of other drilling equipment, such as, for example and without limitation, the spooling device. In contrast to conventional approaches, the disclosed arrangement and position of the wireline system can provide, the drilling operator with a free view of the wireline winch (drum), thereby permitting the drilling operator to react much faster in the event of such issues and reducing the risk of damage to the cable and other elements of the drilling system.

In operation, it is contemplated that the configuration of the wireline system disclosed herein can permit placement of the wireline crane underneath the drill head, thereby reducing or eliminating the quantity of mud that typically flows out of the drill hole and covers the drill rig when a drilling cable is pulled out of the drill hole. Additionally, as further disclosed herein, it is contemplated that the disclosed placement of the wireline assembly can provide a drill operator with an improved view of drilling operations. It is further contemplated that the placement of the wireline assembly in front of the mast in a lower position can increase the serviceability and maintenance of the drum. No working on height is necessary, which, in combination with the improved visibility offered by the placement of the drum, can increase the safety of the drilling system.

As further disclosed herein, it is contemplated that the hydraulic motor and/or the bearing of the drum can be remounted and/or exchanged without unwinding the complete cable from the drum. It is further contemplated that the connection housing, the support flange, and the bearing can be minimally spaced from the inner diameter of the drum, thereby permitting substantially centered placement of the drum by remount of the motor and/or bearing.

In exemplary aspects, and as further disclosed herein, it is contemplated that the wireline assembly can be equipped with a rotation counter that monitors or tracks the rotation of the wireline assembly to help the operator control the operation of the drum during high-speed pulling. It is contemplated that the rotation counter can permit the operator to approximate the timing of the core exiting the drill hole.

In exemplary aspects, the drill head of the drilling system can be mounted on a sled (or carriage), which can be guided on or into the mast. It is contemplated that the wireline system of the present invention can be coupled to and/or used with any conventional sled design. In operation, the sled can be configured to create the feed movement (upward or downward) of the drill head. The drill head, in turn, can create the rotation and torque to drill drilling rods into the drilling formation. The drilling rods can be supplied for connection to the drill head by screwing, unscrewing or by chuck. This rod handling function can happen by different processes as are known in the art.

The drill head can be mounted on a fixed sled, tilting sled or sled with lateral movement (right or left direction). The rod supply can occur manually (by hand) or with the support of a lifting device, such as, for example and without limitation, a winch, a manipulator arm, a rod presenter, and the like, when the sled is positioned in the drilling line. One skilled in the art will appreciate that, for each different type of sled mount, the rod supply can be different. It is further contemplated that the drill rod supply can comprise supplying the rods from the front of the drill rig in an angle ranging from 90° (horizontal) to about 45° relative to the drill head or similar to a fixed sled in drilling line 0°. In this process, upon reaching an angle between about 45° to 90°, the drill head must be tilted out of the drilling line. The benefit of the horizontal to acute angle rod supply has the benefit of providing relatively easy rod handling. However, a low working height (tilt out angle of the drill head) is preferred, particularly with manual, horizontal drill rod supply processes.

In one exemplary aspect, the drill head can be equipped with a chuck, top drive spindle or/and an additional rod clamp on the head, to fix the rod during the tilting function into and out of the drilling line on the drill head. A flushing medium can be provided using a flushing head (swivel), which is connected to the rotary head in the drill string. The flushing head can be mounted in front of or on the rear side of the drill head. The rotary head can be equipped with a plurality of hoses for hydraulic functions and for distributing the flushing medium. The drill head can be configured to move and rotate, especially during diamond core exploration drilling, which is typically very stiff without vibrations and slip stick. Due to the long distance of front-to-rear drill guiding systems, it is contemplated that the guiding of the sled must be highly stable and substantially exactly in alignment with the drilling line. The feed system can work without slip stick and is configured to provide the necessary feed forces (pull-/push force) to the drill string.

Disclosed herein, in various exemplary aspects, and with reference to FIGS. 12-17, is an exemplary sled 400 for selectively adjusting the angular orientation of a drill head 230 relative to the longitudinal axis 212 of a mast 210. In these aspects, it is contemplated that the drill head 230 can be a fixed head, a tilting head, or a head configured for lateral movement. It is further contemplated that the sled 400 can optionally be used with a wireline system as disclosed herein.

In one aspect, and with reference to FIGS. 12-15, the sled 400 can comprise a base 410 configured for mounting to the mast 210. In this aspect, the base 410 can have opposed first and second end portions 412, 414. It is contemplated that the first end portion 412 can be spaced from the second end portion 414 relative to the longitudinal axis 212 of the mast 210.

In another aspect, and with reference to FIGS. 12-15, the sled 400 can comprise first and second linkage assemblies 420*a*, 420*b*. In this aspect, it is contemplated that each linkage assembly 420*a*, 420*b* can comprise a first linkage 422 pivotally secured to the first end portion 412 of the base 410 at a first pivoting location 424, a second linkage 430 pivotally secured to the second end portion 414 of the base at a second pivoting location 432, and a cradle 440 secured to the base and having a longitudinal axis 442. In an additional aspect, the first linkage 422 can extend from the first end portion 412 of the base 410 to the second end portion 414 of the base. In a further aspect, the second linkage 430 can extend from the second end portion 414 of the base 410 to the first end portion 412 of the base. In this aspect, the first linkage 422 can be selectively pivotally secured to the second linkage 430 at a third pivoting location 450. Optionally, the linkage assemblies 420*a*, 420*b* can comprise a third linkage 445 that is pivotally coupled to the first and second linkages at the third pivoting location 450 and to the base at the second pivoting location. It is contemplated that the third linkage 445 can be positioned radially inwardly from the first and second linkages 422, 430 and can be configured to support portions of the cradle and/or additional elements of the sled, including, for example, at least a portion of the locking assembly 470. Optionally, in further exemplary aspects, it is contemplated that the second end portion 414 of the base 410 can comprise a structure that projects upwardly from other portions of the base and defines the second pivoting location 432. In still further exemplary aspects, and with reference to FIG. 12-15, it is contemplated that the third pivoting location can optionally be positioned slightly above the second pivoting location, with both the second and third pivoting locations being spaced significantly farther from the base than the first pivoting location.

In still another aspect, the cradle 440 can be positioned between the first and second linkage assemblies 422, 430. In this aspect, the cradle 440 can be configured to receive the drill head 230 in an operative position. In the operative position, the drill head 230 can be configured for drilling operations as disclosed herein. In operation, the first linkage 422 of each linkage assembly 420*a*, 420*b* can be configured for selective pivoting relative to the first and third pivoting locations 424, 450 of the linkage assembly, and the second linkage 430 of each linkage assembly can be configured for selective pivoting relative to the second and third pivoting locations 432, 450 of the linkage assembly to permit movement of the cradle 440 about and between a straight position in which the longitudinal axis 442 of the cradle is aligned with the longitudinal axis 212 of the mast 210 (corresponding to full extension of the first end portion 412 of the base 410 relative to the second end portion 414 of the base) and an angled position in which the longitudinal axis of the cradle is positioned at a selected angle relative to the longitudinal axis of the mast (corresponding to a position at which the first end portion of the base is at least partially retracted toward the second end portion of the base). Optionally, it is contemplated that the selected angle can range from about 0 degrees to about 90 degrees. In other optional aspects, the selected angle can range from about 30 degrees to about 60 degrees.

Figure 15:
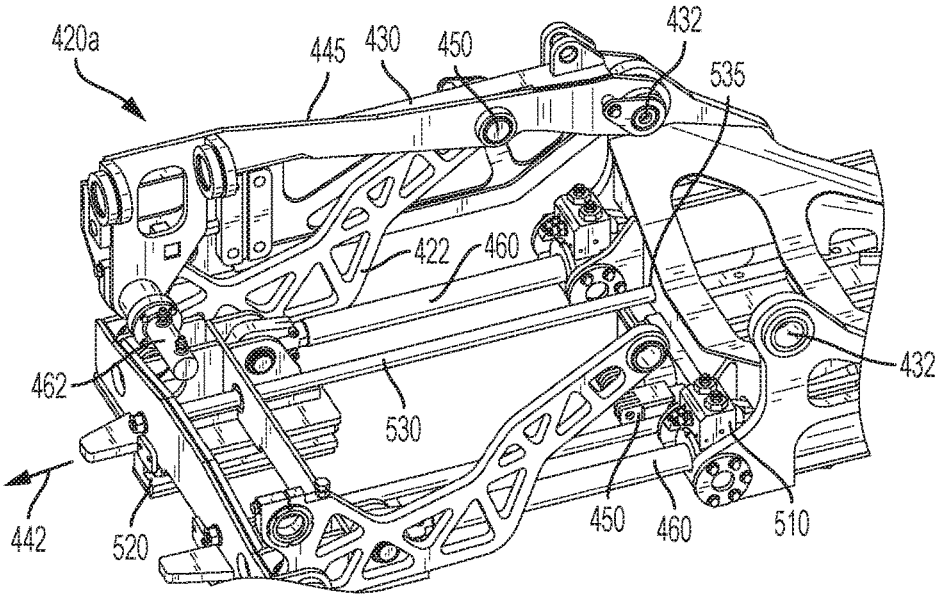
FIG. 15 is a close-up perspective view of a rear portion of an exemplary tilting sled as disclosed herein.

Optionally, in exemplary aspects, and with reference to FIG. 15, when the cradle 440 is in the straight position, the third pivoting location 450 of each linkage assembly 420*a*, 420*b* can be positioned between the first and second pivoting locations 424, 432 of each linkage assembly relative to the longitudinal axis 442 of the cradle. In exemplary aspects, it is contemplated that the third pivoting location 450 (where the first linkage is pivotally connected to the second linkage) can be spaced from the second pivoting location 432 (where the second linkage is pivotally connected to the second end portion of the base) to thereby create a momentum arm during the tilting of the cradle that results from the retraction and extension of the hydraulic cylinders as further disclosed herein.

In further exemplary aspects, and with reference to FIGS. 12-15, the sled 400 can comprise at least one actuator 460 operatively secured to the second end portion 414 of the base 410. In these aspects, the at least one actuator 460 can be operatively coupled to the first end portion 412 of the base 410. As further disclosed herein, the at least one actuator 460 can be configured to selectively linearly translate the first end portion 412 of the base 410 toward and away from the second end portion 414 of the base, thereby effecting selective movement of the cradle about and between the straight position and the angled position. When the first end portion 412 of the base 410 is fully extended (away from the second end portion 414 of the base), the cradle 440 will be positioned in the straight position. In contrast, as the first end portion 412 of the base 410 is retracted toward the second end portion 414 of the base, the linkage assemblies 420*a*, 420*b* disclosed herein can be configured to move the cradle 440 toward the angled position. Optionally, in one aspect, the at least one actuator 460 can comprise at least one hydraulic cylinder. However, it is contemplated that any conventional linear actuator can be used. In additional optional aspects, the sled 400 can further comprise a locking assembly 470 configured to selectively lock the cradle 440 to the first end portion 412 of the base 410 to thereby prevent movement of the base relative to the cradle.

In use, it is contemplated that the sled can support the rotary head during drilling, rod-handling, pulling of drill string, core/geothermal loop handling, and flushing operations. It is still further contemplated that the sled can be configured to move (up and down) relative to the longitudinal axis of the mast. It is contemplated that the sled can be guided to the mast by different styles of equipment, such as, for example and without limitation, rollers and/or guiding rails. It is further contemplated that the sled can create required feeding forces by various known systems, such as, for example and without limitation, a hydraulic cylinder, a chain/cable pulley, direct feed cylinder pulling, or feed gear pulling by chain/cable.

The sled disclosed herein can be configured for use with horizontal (light angle) manual loading or with a rod loader that supplies drill rods from the front of the drill rig. In operation, and as further disclosed herein, the sled disclosed herein can be configured to tilt the drill head as required to permit loading of drill rods using these techniques.

Figure 12:
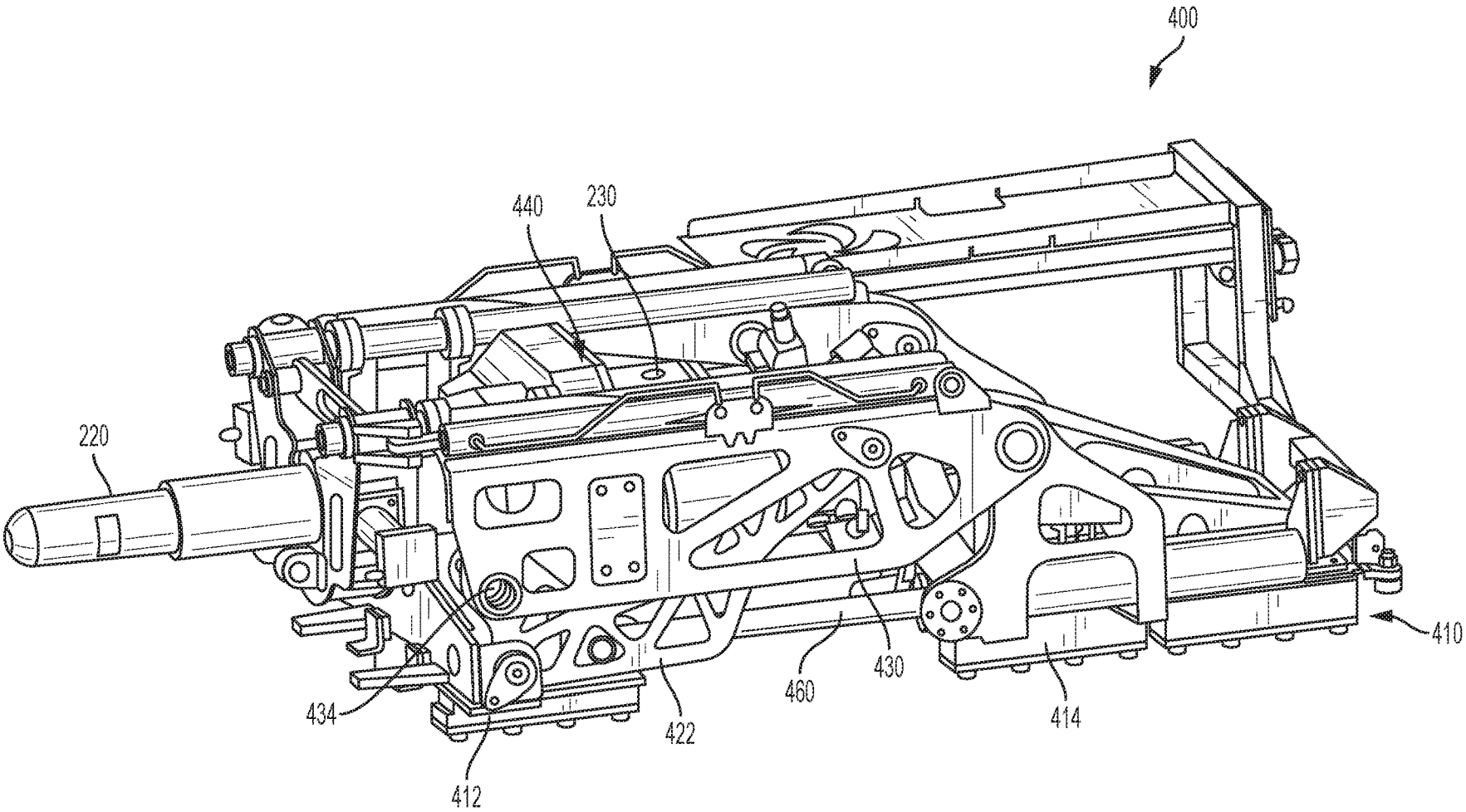
FIG. 12 is a perspective view of an exemplary tilting sled as disclosed herein, holding a drill head.
Figure 13:
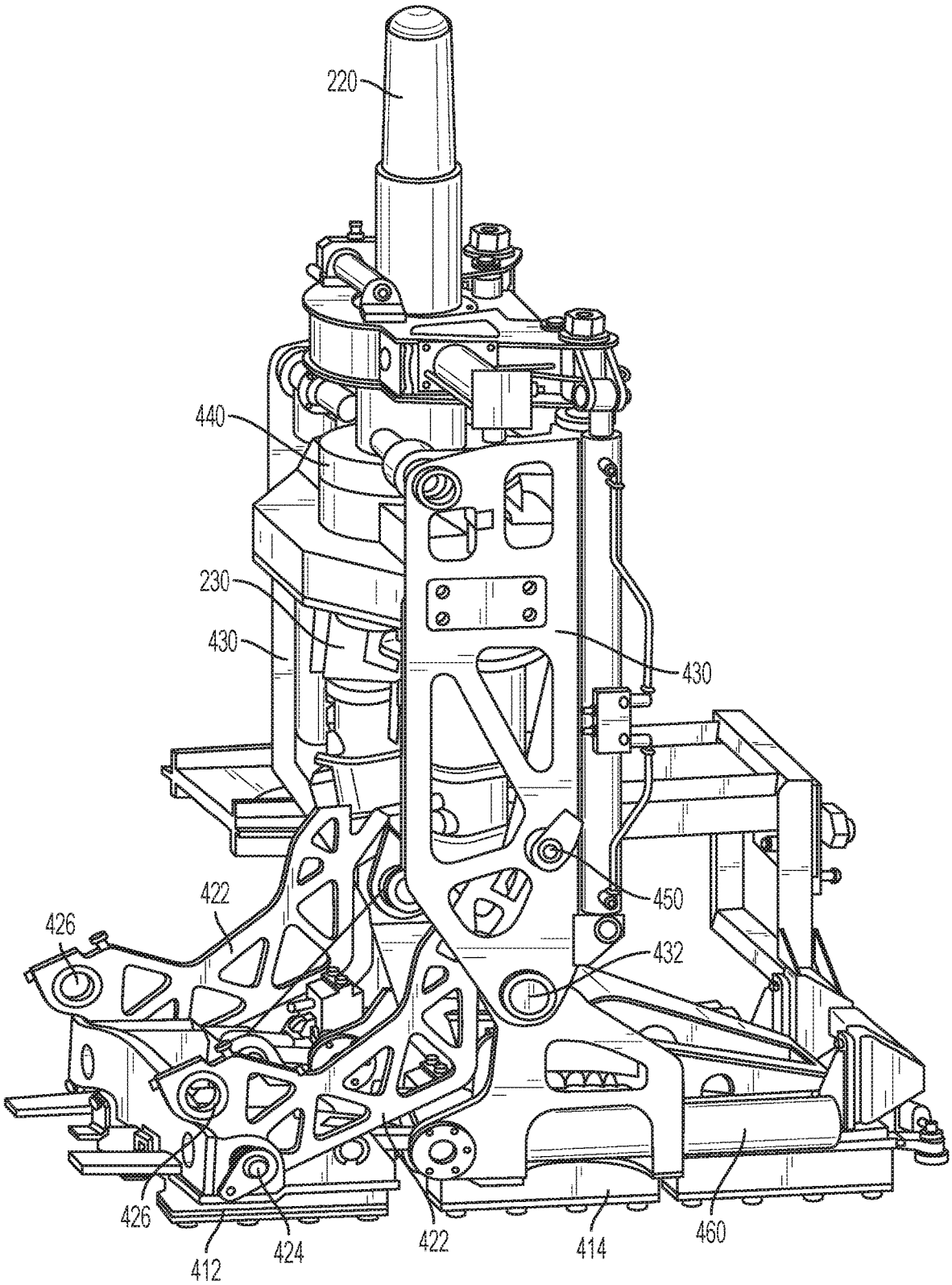
FIG. 13 is a perspective view of an exemplary tilting sled as disclosed herein, holding a drill head at a fully tilted position.
Figure 14:
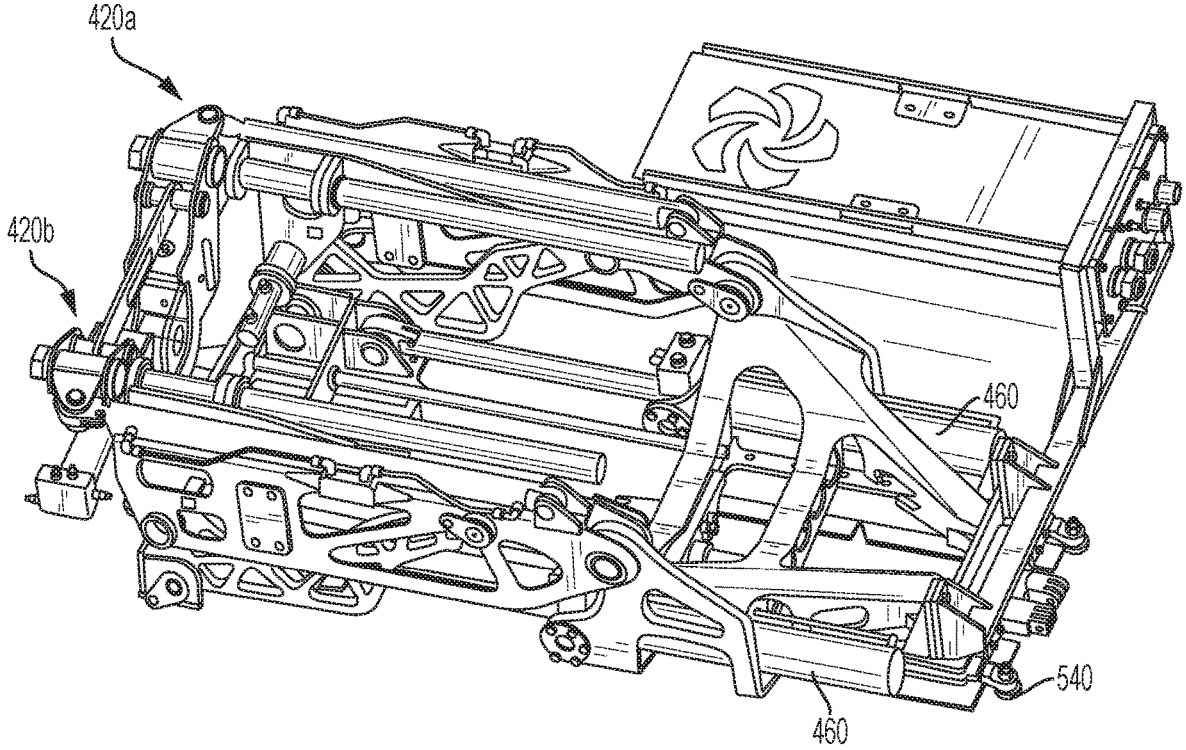
FIG. 14 is an isolated perspective view of an exemplary tilting sled as disclosed herein.
Figure 17:
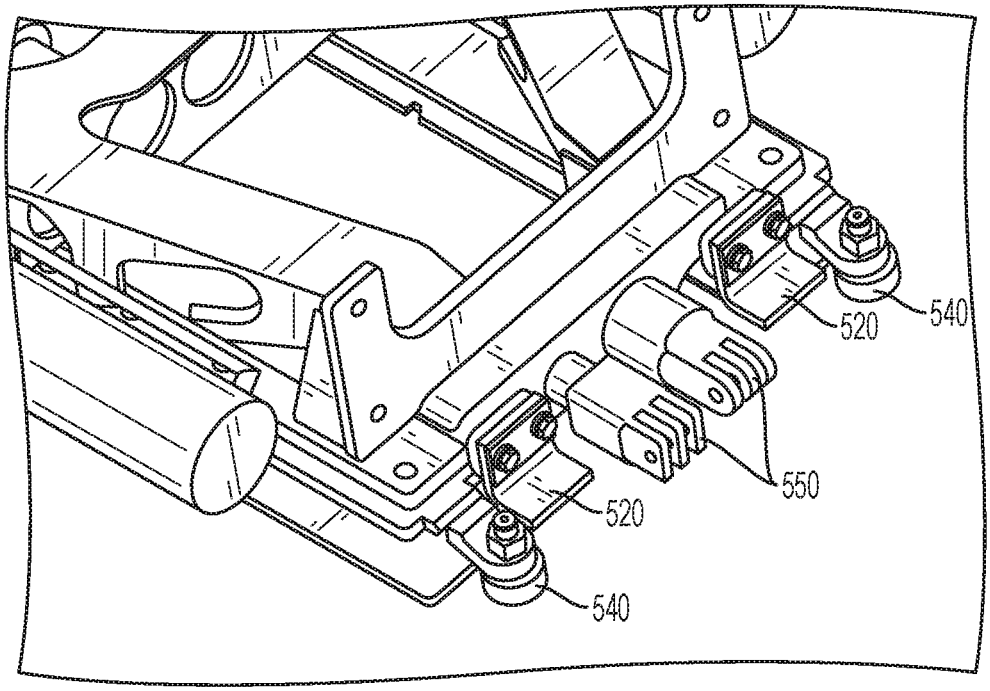
FIG. 17 is a close-up perspective view depicting exemplary rollers, guiding rails, and chain/cable connections of a tilting sled, as disclosed herein.

As shown in FIGS. 12-13, the sled is generally designed in two guiding sections, namely, a front section secured to and including the first end portion 412 of the base 410 and a rear section secured to and including the second end portion 414 of the base. The rear guiding section generally corresponds to the basic sled. As shown in FIG. 17, a feed chain 550 can be mounted on the rear portion of the sled (e.g., on the second end portion of the base).

As shown in FIG. 15, each hydraulic cylinder 460 (or other actuator) can be provided with an integral safety valve (load holding valve) 510. It is contemplated that the cylinders 460 can be mounted to the base 410 or other housing portion of the sled with a pivoting connection. During extension and retraction of the hydraulic cylinders 460, guiding of the front portion of the sled to the mast can be achieved by the use of guiding rails 520 or rollers 540, such as those shown in FIGS. 14-15 and 17. With reference to FIGS. 15 and 17, it is contemplated that two additional guiding bars 530 can be provided between the front and rear sections (e.g., between the first and second end portions of the base) of the sled to protect against a slip stick of the front section (e.g., first end portion) of the sled, which can occur due to a short guiding length or short roller distance. It is further contemplated that the guiding bars 530 can create substantially parallel movement of the two hydraulic cylinders 460. Optionally, the guiding bars 530 can be surrounded by bushings 535.

In exemplary aspects, when the hydraulic cylinders (or other actuators) 460 are extended, the sled 400 can be positioned in a drilling position (straight orientation). If the hydraulic cylinders (or other actuators) 460 are retracted (such as, for example, with a 500 mm stroke), then the sled 400 can be positioned in a tilting position. In this position, and with reference to FIG. 13, it is contemplated that the front sled portion (e.g., the first end portion 412 of the base 410) can be positioned proximate the rear section of the sled (e.g., the second end portion 414 of the base) to thereby create additional space underneath the sled and make the sled more compact, which, in turn, can reduce the working height of the drilling system.

Figure 16:
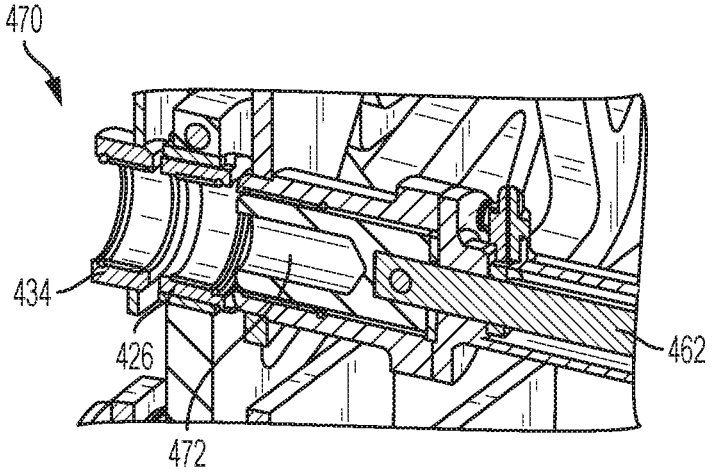
FIG. 16 is an isolated view of an exemplary hydraulic cylinder and an exemplary locking pin of a tilting sled, as disclosed herein.

In exemplary aspects, and with reference to FIG. 16, when the sled 400 is in the drilling position, the sled can be locked by a locking pin 472 that is selectively actuated by and operatively coupled to a hydraulic cylinder (or other actuator) 462. In these aspects, it is contemplated that the locking pin 472 can be configured to absorb kinematic gaps to thereby maintain the stability of drilling operations.

With reference to FIG. 16, it is contemplated that the first and second linkages 422, 430 can each have respective sleeves 426, 434 that are substantially aligned or centered together when the sled 400 is in the drilling (straight) position. When the sled 400 is positioned in the drilling position, the locking pin 472 can be permitted to extend through both sleeves 426, 434 to a locked position. Conversely, the sled 400 is only allowed to tilt when the locking pin 472 is positioned in an unlocked (retracted) position in which the locking pin is not received within either sleeve 426, 434 and the first and second linkages 422, 430 are able to move freely relative to each another. Although two hydraulic cylinders are disclosed as the means for effecting extension and retraction of the locking pins, it is contemplated that other conventional means for effecting linear extension and retraction can be employed within the sled and drilling system as disclosed herein.

Generally, it is contemplated that all disclosed sleeves and pivoting joints of the sled can be provided with wear sleeves and/or bushings as are known in the art. Generally, it is further contemplated that the sled can be weight-optimized to provide a stable design.

As shown in FIGS. 12-15, the rotary drill head 230 can be mounted to the second linkage 430 in front of the second pivoting location 432. It is contemplated that, in the tilting position, this configuration, with the second pivoting location 432 behind the head connection, can provide additional space for a flushing head (swivel) and/or hoses (e.g., hydraulic hoses) on a rear side of the rotary head.

As described above, and with reference to FIGS. 14-15 and 17, the sled 400 can be guided with at least two guiding rails 520 and/or rollers 540. In exemplary aspects, six guiding rails can be used, with two on the front section of the sled (e.g., on the first end portion of the base) and four guiding rails on the rear section of the sled (e.g., on the second end portion of the base). It is contemplated that eccentric rollers can be used to adjust guiding of the sides of the sled, with at least one roller (optionally, two rollers) positioned at each corner of the sled. In exemplary aspects, wipers can be provided for cleaning the mast rails during movement of the sled.

In exemplary aspects, and with reference to FIG. 17, the sled can be connected with a cylinder chain/cable pulley system 550. The chain and/or cable can be connected on the upper and/or lower end of the rear sled section (e.g., the second end portion 414 of the base 410). For each placement of the sled 400, one chain/cable connection can be operatively coupled (e.g., screwed in) to the sled, and the other chain/cable connection can be adjustable by a thread and counter nut or other conventional adjustable fasteners. It is contemplated that this adjustment can permit a correct tensioning of both chain/cable connections for each side of the pulley system. If a direct feeding cylinder is used, then the direct feeding cylinder can be operatively connected to a top portion of the sled.

To provide a desired degree of stability during feeding, the sled can be configured to have an elongate dimension, e.g., the distance between the front and the rear guiding rails/rollers can have sufficient length to create a stable feeding and improved side adjustment. It is contemplated that the elongated length of the sled can help to reduce slip stick issues during feeding.

In operation, the lower section (e.g., first end portion of the base) of the sled must be retracted for the tilting function to occur; upon retraction, a compact configuration of the sled is provided, with the guiding rails and rollers positioned in close proximity to one another. This retraction significantly shortens the complete sled length, for example, by about 500 mm. The feeding system can lower the sled by this additional free space underneath the sled. This, in turn, can create a lower working height, for example by up to about 500 mm in the vertical position. As can be appreciated, the height reduction in angled drilling varies in accordance with the drilling angle.

In operation, it is contemplated that the sled disclosed herein can have a compact and lightweight design compared to conventional tilting sleds. It is further contemplated that, compared to conventional tilting sleds, the sled disclosed herein can be configured to create additional space under the drill head when the head is positioned in a tilting position. This, in turn, can result in a reduction of working height and retract a front section of the sled proximate a rear section of the sled. In exemplary aspects, it is contemplated that, when the sled is positioned in the drilling position, the locking system of the sled can maintain its stability while absorbing kinematic clearance. In still further aspects, it is contemplated that the disclosed configuration of the sled can create additional space to accommodate a flushing head and hoses when the sled is positioned in the tilting position. In additional aspects, it is further contemplated that the feed chain holder of the rear section of the sled can be configured to permit movement of the front section of the sled above a lower mast roller and to provide a lower working height. In these aspects, it is further contemplated that the feed chain lengths can be selectively adjustable.

In operation, the retraction of the front section of the sled relative to the rear section of the thread can simultaneously create a compact sled and provide the tilting function to the drill head. In the tilting position, it is contemplated that the disclosed sled can provide a lower working height than is possible with conventional tilting sleds. It is further contemplated that this result can be achieved regardless of the type of retraction mechanism employed (for example, and without limitation, cylinder, rack and pinion, and the like).

Exemplary Aspects

In various exemplary aspects, disclosed herein is a wireline system for use on a drill rig comprising a mast, a drill string, and a drill head configured to impart rotation to the drill string within a drilling formation, the mast having a longitudinal axis and opposed first and second ends, the first end of the mast being configured for positioning proximate the drilling formation, the drill rig having a first transverse axis and a second transverse axis extending perpendicularly relative to the first transverse axis, wherein when the mast is positioned in a vertical position, the first and second transverse axes are substantially perpendicular to the longitudinal axis of the mast, wherein the first transverse axis divides the drill rig into a front portion and a back portion, wherein the second transverse axis extends from the front portion of the drill rig to the back portion of the drill rig, the wireline system comprising: a wireline assembly operatively secured to the mast at a first axial location relative to the longitudinal axis of the mast, the first axial location being proximate the first end of the drill mast, wherein the wireline assembly comprises a drum configured for engagement with a drilling cable; and a roller assembly operatively secured to the mast at a second axial location relative to the longitudinal axis of the mast, the second axial location being positioned between the first axial location and the second end of the mast relative to the longitudinal axis of the mast, wherein the roller assembly is configured for engagement with the drilling cable, wherein the wireline assembly and the roller assembly are positioned within the front portion of the drill rig, and wherein at least a portion of the wireline assembly and at least a portion of the roller assembly are axially spaced from the mast relative to the second transverse axis.

In another exemplary aspect, when the drill head is positioned at a top position relative to the longitudinal axis of the mast, the roller assembly is positioned between the wireline assembly and the drill head relative to the longitudinal axis of the mast.

In another exemplary aspect, at least a portion of the wireline assembly and at least a portion of the roller assembly are axially spaced from the mast and the drill head relative to the first transverse axis.

In another exemplary aspect, the wireline assembly and the roller assembly are substantially axially aligned along an axis extending at a selected angle relative to the longitudinal axis of the mast. In another exemplary aspect, the selected angle is a selected acute angle. In another exemplary aspect, the wireline assembly and the roller assembly are substantially axially aligned along an axis extending substantially parallel to the longitudinal axis of the mast.

In another exemplary aspect, during operation of the drill rig, an axial distance between the wireline assembly and the roller assembly relative to the longitudinal axis of the mast remains substantially constant.

In another exemplary aspect, the wireline assembly comprises a base portion and opposed first and second support brackets, and wherein the drum is positioned between the first and second support brackets. In another exemplary aspect, the drum has a rotational axis and defines an interior chamber extending axially relative to the rotational axis, wherein the wireline system further comprises a hydraulic motor positioned at least partially within the interior chamber of the drum and operatively coupled to the drum, and wherein upon activation of the hydraulic motor, the drum is configured to rotate about the rotational axis relative to the first and second support brackets. In another exemplary aspect, the wireline system further comprises a spooling device configured to receive the drilling cable from the drum and direct the drilling cable to the roller assembly. In another exemplary aspect, the spooling device comprises a mounting bracket secured to the first and second support brackets, and the mounting bracket and the first and second support brackets define respective openings in communication with the interior chamber of the drum. In another exemplary aspect, the spooling device and the first and second support brackets are configured for selective rotation relative to the drum. In another exemplary aspect, the wireline assembly further comprises a connection housing positioned within the drum, wherein the connection housing is operatively coupled to the first support bracket, the support housing defining a projection that extends circumferentially within the connection housing and is configured to support the hydraulic motor in an operative position.

In another exemplary aspect, the drum comprises a shaft and a central hub, wherein the wireline assembly further comprises a support flange, the central hub being positioned between the first and second support brackets relative to the rotational axis, the central hub being operatively coupled to the projection of the support housing and configured for operative engagement with the hydraulic motor, wherein the second support bracket is configured to support the support flange, the support flange defining a central opening configured to receive the shaft of the drum, the support flange configured to support the shaft of the drum in substantial axial alignment with the central hub relative to the rotational axis. In another exemplary aspect, upon operative engagement between the central hub of the drum and the hydraulic motor, the central hub of the drum is configured to receive a rotational force from the hydraulic motor and to impart the rotational force to the drum. In another exemplary aspect, the central hub and the hydraulic motor are selectively replaceable. In another exemplary aspect, the wireline assembly further comprises a bearing supported by the support flange In another exemplary aspect, the wireline assembly further comprises a drive belt operatively coupled to the shaft of the drum and to the spooling device, and the drive belt is configured to impart rotational movement to the spool as the shaft of the drum rotates relative to the rotational axis. In another exemplary aspect, the drive belt comprises a plurality of interlinking belt gears. In another exemplary aspect, the spooling device has an adjustable spooling rate, and the spooling rate is selectively adjustable by varying a gear ratio between at least one pair of interlinking belt gears.

In another exemplary aspect, the roller assembly comprises a support arm and a pivot joint operatively coupled to the support arm and configured for selective pivotal movement relative to the support arm, and wherein the support arm is operatively secured to the mast at the second axial location. In another exemplary aspect, the roller assembly comprises opposed first and second sheaves and a bracket operatively secured to the pivot joint, the first and second sheaves each defining a respective circumferential groove and being configured for rotation about a respective rotational axis, wherein the circumferential groove of each sheave is configured to receive the wireline cable, and wherein the bracket is configured to engage the first and second sheaves such that the rotational axes of the first and second sheaves are substantially parallel and substantially perpendicular to the longitudinal axis of the mast. In another exemplary aspect, the roller assembly comprises opposed first and second guiding plates, the first and second guiding plates being secured to the bracket, wherein the first guiding plate is spaced from and operatively positioned relative to the first sheave to prevent the wireline cable from disengaging the circumferential groove of the first sheave, and wherein the second guiding plate is spaced from and operatively positioned relative to the second sheave to prevent the wireline cable from disengaging the circumferential groove of the second sheave.

In another exemplary aspect, the first guiding plate cooperates with the circumferential groove of the first sheave to define an inlet of the roller assembly, and wherein the second guiding plate cooperates with the circumferential groove of the second sheave to define an outlet of the roller assembly. In another exemplary aspect, the roller assembly further comprises: at least one inlet roller positioned proximate the inlet of the roller assembly and spaced from the circumferential groove of the first sheave; and at least one outlet roller positioned proximate the outlet of the roller assembly and spaced from the circumferential groove of the second sheave, wherein the at least one inlet roller is configured to guide a wireline cable into the circumferential groove of the first sheave, and wherein the at least one outlet roller is configured to guide the wireline cable as it exits the outlet of the roller assembly.

In another exemplary aspect, the at least one inlet roller and the at least one outlet roller are configured for rotation about respective rotational axes, and wherein the rotational axes of the at least one inlet roller and the at least one outlet roller are substantially parallel to the rotational axes of the first and second sheaves. In another exemplary aspect, the at least one inlet roller is configured to constrain movement of the wireline cable relative to the rotational axis of the at least one inlet roller as the wireline cable enters the inlet of the roller assembly, and wherein the at least one outlet roller is configured to constrain movement of the wireline cable relative to the rotational axis of the at least one outlet roller as the wireline cable exits the outlet of the roller assembly.

In another exemplary aspect, the roller assembly further comprises: a first guiding roller spaced from the inlet of the roller assembly relative to the longitudinal axis of the mast, the first guiding roller configured for rotation about a rotational axis that is substantially perpendicular to the rotational axes of the first and second sheaves; and a second guiding roller spaced from the outlet of the roller assembly relative to the longitudinal axis of the mast, the second guiding roller configured for rotation about a rotational axis that is substantially perpendicular to the rotational axes of the first and second sheaves, wherein the first guiding roller is configured to engage the wireline cable to constrain movement of the wireline cable relative to the rotational axis of the first guiding roller as the wireline cable approaches the inlet of the roller assembly, and wherein the second guiding roller is configured to engage the wireline cable to constrain movement of the wireline cable relative to the rotational axis of the second guiding roller as the wireline cable exits the outlet of the roller assembly.

In further exemplary aspects, disclosed herein is a drilling system for conducting drilling operations within a drilling formation, the drilling system being positioned on a drill rig and comprising: a mast having a longitudinal axis and opposed first and second ends, the first end of the mast being configured for positioning proximate the drilling formation, wherein the drilling system has a first transverse axis and a second transverse axis extending perpendicularly relative to the first transverse axis, wherein when the mast is positioned in a vertical position, the first and second transverse axes are substantially perpendicular to the longitudinal axis of the mast, wherein the first transverse axis divides the drill rig into a front portion and a back portion, and wherein the second transverse axis extends from the front portion of the drill rig to the back portion of the drill rig; a drill string; a drill head configured to impart rotation to the drill string, the drill head being configured for selective movement relative to the longitudinal axis of the mast; a wireline assembly operatively secured to the mast at a first axial location relative to the longitudinal axis of the mast, the first axial location being proximate the first end of the drill mast, wherein the wireline assembly comprises a drum configured for engagement with a drilling cable; and a roller assembly operatively secured to the mast at a second axial location relative to the longitudinal axis of the mast, the second axial location being positioned between the first axial position and the second end of the mast relative to the longitudinal axis of the mast, wherein the roller assembly is configured for engagement with the drilling cable, wherein the wireline assembly and the roller assembly are positioned within the front portion of the drill rig, and wherein at least a portion of the wireline assembly and at least a portion of the roller assembly are axially spaced from the mast relative to the second transverse axis.

In another exemplary aspect, the drill head is configured for movement about and between a top portion and a bottom portion relative to the longitudinal axis of the mast, the bottom position being proximate the first end of the mast and the top position being proximate the second end of the mast, and wherein when the drill head is positioned at the top position, the roller assembly is positioned between the wireline assembly and the drill head relative to the longitudinal axis of the mast.

In another exemplary aspect, at least a portion of the wireline assembly and at least a portion of the roller assembly are axially spaced from the mast and the drill head relative to the first transverse axis. In another exemplary aspect, the wireline assembly and the roller assembly are substantially axially aligned along an axis extending at a selected angle relative to the longitudinal axis of the mast. In another exemplary aspect, the selected angle is a selected acute angle. In another exemplary aspect, the wireline assembly and the roller assembly are substantially axially aligned along an axis extending substantially parallel to the longitudinal axis of the mast.

In another exemplary aspect, during operation of the drilling system, an axial distance between the wireline assembly and the roller assembly relative to the longitudinal axis of the mast remains substantially constant.

In another exemplary aspect, the wireline assembly comprises a base portion and opposed first and second support brackets, and the drum is positioned between the first and second support brackets.

In another exemplary aspect, the drum has a rotational axis and defines an interior chamber extending axially relative to the rotational axis, wherein the wireline assembly further comprises a hydraulic motor positioned at least partially within the interior chamber of the drum and operatively coupled to the drum, and wherein upon activation of the hydraulic motor, the drum is configured to rotate about the rotational axis relative to the first and second support brackets.

In another exemplary aspect, the drilling system further comprises a spooling device configured to receive the drilling cable from the drum and direct the drilling cable to the roller assembly.

In another exemplary aspect, the spooling device comprises a mounting bracket secured to the first and second support brackets, and the mounting bracket and the first and second support brackets define respective openings in communication with the interior chamber of the drum.

In another exemplary aspect, the spooling device and the first and second support brackets are configured for selective rotation relative to the drum.

In another exemplary aspect, the drilling system further comprises a safety cage, the safety cage having a door, wherein the wireline assembly is positioned within the safety cage, and wherein the door of the safety cage is configured to permit selective access to the wireline assembly and the drill string.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A wireline assembly configured to be operatively secured to a mast of a drill rig, the wireline assembly comprising:

a drum configured for engagement with a drilling cable, wherein the drum has a rotational axis and defines an interior chamber extending axially relative to the rotational axis;

opposed first and second support brackets, wherein the drum is positioned between the first and second support brackets and configured to rotate relative to the first and second support brackets;

a motor positioned at least partially within the interior chamber of the drum and operatively coupled to the drum, wherein upon activation of the motor, the drum is configured to rotate about the rotational axis relative to the first and second support brackets; and a spooling device configured to receive the drilling cable from the drum and direct the drilling cable to a roller assembly of the drill rig, wherein the spooling device comprises a mounting bracket that is rotationally coupled to the first and second support brackets, and wherein the mounting bracket and the first and second support brackets define respective openings in communication with the interior chamber of the drum, wherein the spooling device is configured for selective rotation relative to the drum, wherein the spooling device is configured for rotation about and between a first rotational position and a second rotational position, wherein in the first rotational position, the spooling device is oriented substantially parallel to a longitudinal axis of the mast of the drill rig, and wherein in the second rotational position, the spooling device is angularly oriented relative to the longitudinal axis of the mast of the drill rig; and at least one protective mesh element that circumferentially surrounds at least a portion of the drum, wherein the mounting bracket of the spooling device is secured to the at least one protective mesh element such that the at least one protective mesh element rotates together with the spooling device.

2. The wireline assembly of claim 1, further comprising a connection housing positioned within the drum, wherein the connection housing is operatively coupled to the first support bracket, the connection housing defining a projection that extends circumferentially within the connection housing and is configured to support the motor in an operative position.

3. The wireline assembly of claim 2, wherein the drum comprises a shaft and a central hub, wherein the wireline assembly further comprises a support flange, the central hub being positioned between the first and second support brackets relative to the rotational axis, the central hub being operatively coupled to the projection of the connection housing and configured for operative engagement with the motor, wherein the second support bracket is configured to support the support flange, the support flange defining a central opening configured to receive the shaft of the drum, the support flange configured to support the shaft of the drum in substantial axial alignment with the central hub relative to the rotational axis.

4. The wireline assembly of claim 3, wherein upon operative engagement between the central hub of the drum and the motor, the central hub of the drum is configured to receive a rotational force from the motor and to impart the rotational force to the drum.

5. The wireline assembly of claim 4, wherein the central hub and the motor are selectively replaceable.

6. The wireline assembly of claim 3, further comprising a bearing supported by the support flange, wherein the bearing surrounds at least a portion of the shaft of the drum.

7. The wireline assembly of claim 1, wherein the spooling device is configured for rotation about and between at least three rotational positions.

8. The wireline assembly of claim 1, wherein the drum is configured to receive a wireline cable being spooled in opposing first and second directions, wherein the wireline assembly further comprises first and second connection holes that are each configured to receive the wireline cable as the wireline cable is spooled in either of the first and second directions.

9. The wireline assembly of claim 1, further comprising a drive belt operatively coupled to the shaft of the drum and to the spooling device, wherein the drive belt is configured to impart rotational movement to the spooling device as the shaft of the drum rotates relative to the rotational axis, wherein the drive belt comprises a plurality of interlinking belt gears, wherein the spooling device has an adjustable spooling profile, and wherein the spooling profile is selectively adjustable by varying a gear ratio between at least one pair of interlinking belt gears.

10. A method comprising:

operatively securing a wireline assembly to a mast of a drill rig, the wireline assembly comprising:

a drum engaged with a drilling cable, wherein the drum has a rotational axis and defines an interior chamber extending axially relative to the rotational axis;

opposed first and second support brackets, wherein the drum is positioned between the first and second support brackets and configured to rotate relative to the first and second support brackets;

a motor positioned at least partially within the interior chamber of the drum and operatively coupled to the drum, wherein upon activation of the motor, the drum rotates about the rotational axis relative to the first and second support brackets; and a spooling device that receives the drilling cable from the drum and directs the drilling cable to a roller assembly of the drill rig, wherein the spooling device comprises a mounting bracket that is rotationally coupled to the first and second support brackets, and wherein the mounting bracket and the first and second support brackets define respective openings in communication with the interior chamber of the drum; and at least one protective mesh element that circumferentially surrounds at least a portion of the drum, wherein the mounting bracket of the spooling device is secured to the at least one protective mesh element; and selectively rotating the spooling device relative to the drum from a first rotational position to a second rotational position, wherein in the first rotational position, the spooling device is oriented substantially parallel to a longitudinal axis of the mast of the drill rig, and wherein in the second rotational position, the spooling device is angularly oriented relative to the longitudinal axis of the mast of the drill rig, wherein the at least one protective mesh element rotates together with the spooling device.

11. The method of claim 10, wherein the method further comprises remounting or exchanging the motor of the wireline assembly without unwinding the drilling cable from the drum.

12. A wireline assembly configured to be operatively secured to a mast of a drill rig, the wireline assembly comprising:

a drum configured for engagement with a drilling cable, wherein the drum has a rotational axis and defines an interior chamber extending axially relative to the rotational axis;

opposed first and second support brackets, wherein the drum is positioned between the first and second support brackets and configured to rotate relative to the first and second support brackets;

a motor positioned at least partially within the interior chamber of the drum and operatively coupled to the drum, wherein upon activation of the motor, the drum is configured to rotate about the rotational axis relative to the first and second support brackets; and a spooling device configured to receive the drilling cable from the drum and direct the drilling cable to a roller assembly of the drill rig, wherein the spooling device comprises a mounting bracket that is rotationally coupled to the first and second support brackets, and wherein the mounting bracket and the first and second support brackets define respective openings in communication with the interior chamber of the drum, wherein the spooling device is configured for selective rotation relative to the drum; and a connection housing positioned within the drum, wherein the connection housing is operatively coupled to the first support bracket, the connection housing defining a projection that extends circumferentially within the connection housing and is configured to support the motor in an operative position, wherein the drum comprises a shaft and a central hub, wherein the wireline assembly further comprises a support flange, the central hub being positioned between the first and second support brackets relative to the rotational axis, the central hub being operatively coupled to the projection of the connection housing and configured for operative engagement with the motor, wherein the second support bracket is configured to support the support flange, the support flange defining a central opening configured to receive the shaft of the drum, the support flange configured to support the shaft of the drum in substantial axial alignment with the central hub relative to the rotational axis.

13. The wireline assembly of claim 12, wherein upon operative engagement between the central hub of the drum and the motor, the central hub of the drum is configured to receive a rotational force from the motor and to impart the rotational force to the drum.

14. The wireline assembly of claim 12, further comprising a bearing supported by the support flange, wherein the bearing surrounds at least a portion of the shaft of the drum.

15. A wireline assembly configured to be operatively secured to a mast of a drill rig, the wireline assembly comprising:

a drum configured for engagement with a drilling cable, wherein the drum has a rotational axis and defines an interior chamber extending axially relative to the rotational axis;

opposed first and second support brackets, wherein the drum is positioned between the first and second support brackets and configured to rotate relative to the first and second support brackets;

a motor positioned at least partially within the interior chamber of the drum and operatively coupled to the drum, wherein upon activation of the motor, the drum is configured to rotate about the rotational axis relative to the first and second support brackets; and a spooling device configured to receive the drilling cable from the drum and direct the drilling cable to a roller assembly of the drill rig, wherein the spooling device comprises a mounting bracket that is rotationally coupled to the first and second support brackets, and wherein the mounting bracket and the first and second support brackets define respective openings in communication with the interior chamber of the drum, wherein the spooling device is configured for selective rotation relative to the drum, wherein the spooling device is configured for rotation about and between a first rotational position and a second rotational position, wherein in the first rotational position, the spooling device is oriented substantially parallel to a longitudinal axis of the mast of the drill rig, and wherein in the second rotational position, the spooling device is angularly oriented relative to the longitudinal axis of the mast of the drill rig; and a drive belt operatively coupled to a shaft of the drum and to the spooling device, wherein the drive belt is configured to impart rotational movement to the spooling device as the shaft of the drum rotates relative to the rotational axis, wherein the drive belt comprises a plurality of interlinking belt gears, wherein the spooling device has an adjustable spooling rate, and wherein the spooling profile is selectively adjustable by varying a gear ratio between at least one pair of interlinking belt gears.

* * * * *